US008256604B2

(12) United States Patent
Ohishi

(10) Patent No.: US 8,256,604 B2
(45) Date of Patent: Sep. 4, 2012

(54) BANKNOTE PROCESSING MACHINE

(75) Inventor: Taki Ohishi, Tokyo (JP)

(73) Assignee: Laurel Precision Machines Co., Ltd., Osaka (JP)

( * ) Notice: Subject to any disclaimer, the term of this patent is extended or adjusted under 35 U.S.C. 154(b) by 103 days.

(21) Appl. No.: 12/829,501

(22) Filed: Jul. 2, 2010

(65) Prior Publication Data

US 2011/0005892 A1 Jan. 13, 2011

(30) Foreign Application Priority Data

Jul. 8, 2009 (JP) ..... P2009-161834

(51) Int. Cl.
*G07F 7/04* (2006.01)

(52) U.S. Cl. ..... 194/206

(58) Field of Classification Search ..... 194/205, 194/206, 207; 902/9, 12, 13, 36; 242/528, 242/534; 209/534; 235/379
See application file for complete search history.

(56) References Cited

U.S. PATENT DOCUMENTS

| | | | | |
|---|---|---|---|---|
| 6,170,822 | B1 | 1/2001 | Kato et al. | |
| 7,422,117 | B2 * | 9/2008 | Myatt | 209/534 |
| 2003/0046232 | A1 | 3/2003 | Peters et al. | |
| 2003/0205618 | A1 | 11/2003 | Katou et al. | |
| 2004/0182677 | A1 * | 9/2004 | Katou et al. | 194/206 |
| 2010/0038420 | A1 | 2/2010 | Peters et al. | |

FOREIGN PATENT DOCUMENTS

| | | |
|---|---|---|
| EP | 0 907 152 A2 | 4/1999 |
| EP | 1 291 831 A2 | 3/2003 |
| JP | 3248972 | 11/2001 |
| KR | 10-2000-0047521 | 7/2000 |
| KR | 10-2009-0044988 | 5/2009 |

OTHER PUBLICATIONS

Notice of Allowance dated Sep. 24, 2011, issued in Korean Application No. 10-2010-0064523 with English Abstract.
Extended European Search Report in EP 10 16 8416 dated Nov. 24, 2010.

* cited by examiner

*Primary Examiner* — Mark Beauchaine
(74) *Attorney, Agent, or Firm* — Nixon & Vanderhye P.C.

(57) ABSTRACT

A banknote processing machine includes: a receipt section which receives a banknote; a temporary storage section which includes a pair of first and second drums, and a tape wound between the pair of first and second drums, the tape having an end fixed to the first drum, a tape section for banknote sheets and a tape section for partition sheets positioned at a side of the end with respect to the tape section for banknote sheets, the temporary storage section releasably receiving a conveyed banknote by winding the conveyed banknote on the first drum together with the tape section for banknote sheets and releasably receiving at least one partition sheet by winding the partition sheet on the first drum together with the tape section for partition sheets; and a control section which causes the temporary storage section to release the partition sheet wound on the first drum, and causes the receipt section to receive the partition sheet from the temporary storage section, in response to the receipt section receiving a banknote.

15 Claims, 9 Drawing Sheets

BANKNOTE PROCESSING MACHINE

BACKGROUND OF THE INVENTION

1. Field of the Invention

The present invention relates to a banknote processing machine.

Priority is claimed on Japanese Patent Applications No. 2009-161834 filed Jul. 8, 2009, the content of which is incorporated herein by reference.

2. Description of Related Art

In a banknote processing machine, banknotes inserted into an input section are identified by an identification section, and then, temporarily received in a temporary storage section. Next, when a return order is input, the banknotes are returned to a return section such that the banknotes can be taken out of the banknote processing machine. On the other hand, when a deposit order is input, the banknotes are received in a receipt section.

For example, Japanese Patent Publication No. 3248972 discloses a banknote processing machine in which, when any counterfeit banknote is identified by an identification section, the counterfeit banknote is automatically and forcedly collected into a collection box installed in the banknote processing machine.

Since the collection box is installed in the banknote processing machine, the collection box is typically opened after completion of customer service. For this reason, when abnormalities such as insertion of counterfeit banknotes occur several times a day, it is impossible to manage the denomination and number of abnormal banknotes forcedly collected into the collection box whenever abnormality processing is performed, i.e., whenever customer processing is performed. In order to manage the abnormality processing (customer) whenever it is performed, the banknote processing machine must be stopped to open the collection box on every occasion, and thus the customer service cannot be smoothly performed.

Of course, it is very advantageous in management to classify banknotes whenever the banknotes are received in the same receipt section, not limited to the collection box for collecting counterfeit banknotes.

SUMMARY OF THE INVENTION

The invention has been achieved in view of the above circumstances, and it is an object of the present invention to provide a banknote processing machine capable of classifying and managing banknotes when the banknotes are received in the same receipt section.

In order to achieve the aforementioned object, a banknote processing machine according to a first aspect of the present invention includes: a receipt section which receives a banknote; a temporary storage section which includes a pair of first and second drums, and a tape wound between the pair of first and second drums, the tape having an end fixed to the first drum, a tape section for banknote sheets and a tape section for partition sheets positioned at a side of the end with respect to the tape section for banknote sheets, the temporary storage section releasably receiving a conveyed banknote by winding the conveyed banknote on the first drum together with the tape section for banknote sheets and releasably receiving at least one partition sheet by winding the partition sheet on the first drum together with the tape section for partition sheets; and a control section which causes the temporary storage section to release the partition sheet wound on the first drum, and causes the receipt section to receive the partition sheet from the temporary storage section, in response to the receipt section receiving a banknote.

In the banknote processing machine according to the first aspect of the present invention, a temporary storage section includes a pair of first and second drums, and a tape wound between the pair of first and second drums, and releasably receives a conveyed banknote by winding the conveyed banknote on the first drum together with the tape section for banknote sheets. The tape has a tape section for partition sheets positioned at a side of an end fixed to the first drum, with respect to the tape section for banknote sheets. The control section causes the temporary storage section to release the partition sheet wound on the first drum, and causes the receipt section to receive the partition sheet from the temporary storage section, in response to the receipt section receiving a banknote. With this structure, when a plurality of banknotes are received in the same receipt section, the partition sheet can be disposed at a desired position, and thus, it is possible to discriminate the banknotes using the partition sheet to manage the denomination and number of banknotes.

Moreover, the temporary storage section releasably receives a partition sheet by winding it on the first drum together with the tape section for partition sheets positioned at a side of an end fixed to the first drum, with respect to the tape section for banknote sheets, and releases the partition sheet as needed. Therefore, there is no need of an exclusive mechanism for receiving and releasing the partition sheet and thus cost can be reduced.

A banknote processing machine according to a second aspect of the present invention includes: a receipt section which receives a banknote; a temporary storage section which includes a pair of first and second drums, and a tape wound between the pair of first and second drums, the temporary storage section releasably receiving a conveyed banknote by winding the conveyed banknote on the first drum together with the tape, and releasably receiving at least one partition sheet by winding the partition sheet on the second drum together with the tape; and a control section which causes the temporary storage section to release the partition sheet wound on the second drum, and causes the receipt section to receive the partition sheet from the temporary storage section, in response to the receipt section receiving a banknote.

In a banknote processing machine according to the second aspect of the present invention, the temporary storage section includes a pair of first and second drums, and a tape wound between the pair of first and second drums, and releasably receives a conveyed banknote by winding the conveyed banknote on the first drum together with the tape. The control section causes the temporary storage section to release the partition sheet wound on the second drum, and causes the receipt section to receive the partition sheet from the temporary storage section, in response to the receipt section receiving a banknote. With this structure, when a plurality of banknotes are received in the same receipt section, the partition sheet can be disposed at a desired place to discriminate the banknotes using the partition sheet, and thus, it is possible to manage the denomination and number of banknotes.

Moreover, a temporary storage section releasably receives a partition sheet by winding it on the second drum together with the tape, and releases the partition sheet as needed. Therefore, there is no necessity of an exclusive mechanism for receiving and releasing the partition sheet, and thus the cost can be reduced.

The banknote processing machine according to the first or second aspect of the present invention may further include: an insertion section which receives a banknote from outside of the machine; an identification section which identifies a banknote received in the insertion section; a counterfeit banknote collection section which receives a banknote identified as a counterfeit banknote by the identification section; a first return section which returns a banknote unidentified by the identification section so as to be removable from the machine; a second return section which returns a banknote released from the temporary storage section so as to be removable from the machine; a receive section which receives a banknote released from the temporary storage section; a first non-taken banknote collection section which receives a banknote remain in the first return section; and a second non-taken banknote collection section which receives a banknote remain in the second return section, and the temporary storage section releasably receives a banknote identified as a genuine banknote by the identification section, and the receipt section includes at least one of the counterfeit banknote collection section, the first non-taken banknote collection section, and the second non-taken banknote collection section.

With this structure, the partition sheet may be introduced from the temporary storage section to at least one of the counterfeit banknote collection section which receives a banknote received in the insertion section and identified as a counterfeit banknote by the identification section, the first return section which returns a banknote unidentified by the identification section so as to be removable from the machine, and a second return section which returns a banknote released from the temporary storage section so as to be removable from the machine. For this reason, it is possible to discriminate and manage the banknotes received in at least one of the counterfeit banknote collection section, the first non-taken banknote collection section, and the second non-taken banknote collection section.

In the banknote processing machine according to the first or second aspect of the present invention, the first return section and the second return section may constitute common return section, the first non-taken banknote collection section and the second non-taken banknote collection section may constitute one common non-taken banknote collection section, and the receipt section may include at least the common non-taken banknote collection section.

With this structure, when the first return section and the second return section constitute common return section, and when the first non-taken banknote collection section and the second non-taken banknote collection section constitute one common non-taken banknote collection section, it is possible to discriminate and manage the banknotes received in the common non-taken banknote collection section.

The banknote processing machine according to the first or second aspect of the present invention may further include a withdrawal section which supplies a banknote released from the receive section so as to be removable from the machine; and a third non-taken banknote collection section which receives a banknote remain in the withdrawal section, and the receipt section may include at least one of the counterfeit banknote collection section, the first non-taken banknote collection section, the second non-taken banknote collection section and the third non-taken banknote collection section.

With this structure, the partition sheet may be introduced from the temporary storage section to at least one of the counterfeit banknote collection section, the first non-taken banknote collection section, the second non-taken banknote collection section, and the third non-taken banknote collection section which receives a banknote remain in the withdrawal section. For this reason, it is possible to discriminate and manage the banknotes received in at least one of the counterfeit banknote collection section, the first non-taken banknote collection section, the second non-taken banknote collection section, and the third non-taken banknote collection section.

In the banknote processing machine according to the first or second aspect of the present invention, the first return section, the second return section and the withdrawal section may constitute one common delivery section, the first non-taken banknote collection section, the second non-taken banknote collection section and the third non-taken banknote collection section may constitute one common non-taken banknote collection section, and the receipt section may include at least the common non-taken banknote collection section.

With this structure, when the first return section, the second return section and the withdrawal section constitute one common delivery section, and when the first non-taken banknote collection section, the second non-taken banknote collection section and the third non-taken banknote collection section constitute one common non-taken banknote collection section, it is possible to discriminate and manage the banknotes received in the common non-taken banknote collection section.

In the banknote processing machine according to the first or second aspect of the present invention, the tape may have a discrimination section which is used for discriminating the tape section for partition sheets from other tape section of the tape.

With this structure, the tape has the discrimination section used to discriminate the tape section for partition sheets from other tape section of the tape, so that it is possible to discriminate the tape section for partition sheets from the other tape section and perform position control using a sensor.

In the banknote processing machine according to the first or second aspect of the present invention, in response to the control section determining that the temporary storage section lacks a partition sheet after performing a normal process mode, the control section may transit to a partition sheet restock process mode for restocking a partition sheet, and the control section may allow transition to the normal process mode only when a partition sheet is restocked in the temporary storage section through the partition sheet restock process mode.

With this structure, in response to the control section determining that the temporary storage section lacks a partition sheet after performing a normal process mode, the control section transits to a partition sheet restock process mode for restocking a partition sheet, and the control section allows transition to the normal process mode only when a partition sheet is restocked in the temporary storage section through the partition sheet restock process mode. For this reason, it is possible to securely prevent the partition sheets from being lacked.

In the banknote processing machine according to the first or second aspect of the present invention, in response to the control section determining that the temporary storage section lacks a partition sheet, the control section may output a restock order signal to request restock of a partition sheet.

With this structure, in response to the control section determining that the temporary storage section lacks a partition sheet, the control section outputs a restock order signal to request restock of a partition sheet. For this reason, for example, even when a preparatory partition sheet storage place is far from the banknote processing machine, it is possible to instruct an external management department or a management center to restock of the partition sheets, and promote smooth service management.

DETAILED DESCRIPTION OF THE INVENTION

A banknote processing machine according to a first embodiment of the present invention will be described with reference to FIGS. 1 to 4. In the following description, an operator side is referred to as a "front side," a side opposite to the operator is referred to as a "rear side," and left and right sides viewed by the operator are referred to as "left and right sides (or lateral sides)."

The banknote processing machine according to a first embodiment of the present invention is a deposit-only machine capable only of depositing and counting banknotes. This banknote processing machine can also deal with foreign banknotes having significantly different sizes according to the denominations of banknotes. The banknote processing machine conveys the banknotes in a conveyance direction along a long side of the banknote, and receives the banknotes. The banknote processing machine may convey the banknotes in a conveyance direction along a short side of the banknote, and receive the banknotes by enlarging a lateral width of the banknote processing machine.

Figure 1:
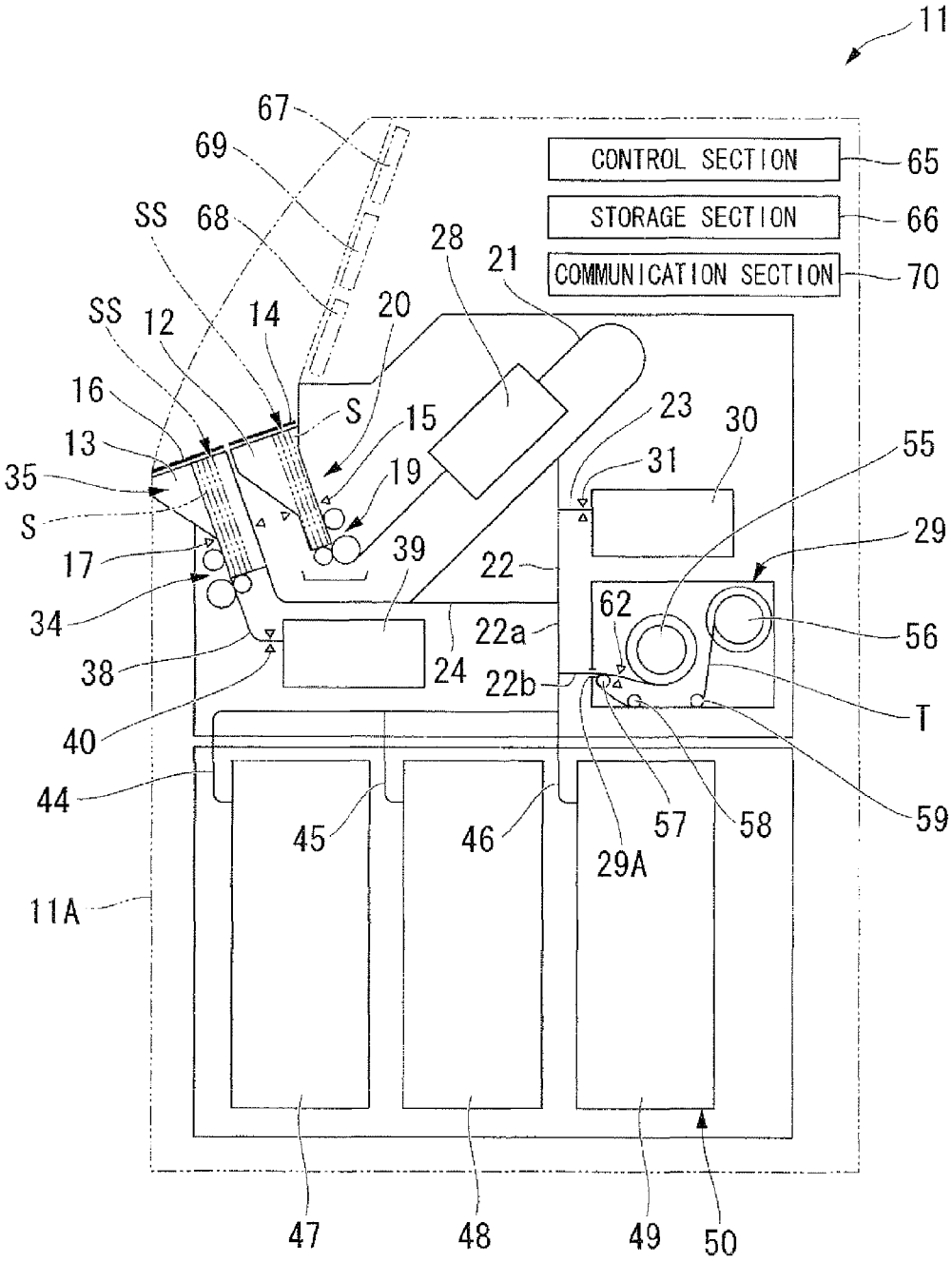
FIG. 1 is a side cross-sectional view schematically showing a banknote processing machine in accordance with a first embodiment of the present invention.

As shown in FIG. 1, the banknote processing machine 11 according to the first embodiment has an insertion port 12 as a transaction opening, which is installed on a side of the front face 11A of a body of the machine and through which banknotes S are inserted from the outside of the machine, and a discharge port 13 as another transaction opening, which is installed in front of the insertion port 12 on the side of the front face 11A and through which the banknotes S are discharged from the inside of the banknote processing machine.

The banknotes S are inserted into the insertion port 12 in a banknote group SS where a plurality of banknotes are stacked in a thickness direction in a rear-down posture in which one end of a long side of each banknote is positioned at an inner side of the machine body, and a short side thereof is aligned in a horizontal direction (i.e. a lateral direction of the machine body). The insertion port 12 is configured to receive the entire banknote S having the longest long side. An insertion port shutter 14 for opening/closing an opening of the insertion port 12 and an insertion detection sensor 15 for detecting banknotes S in the insertion port 12 are installed in the insertion port 12.

The banknotes S are discharged from the discharge port 13 in a front-up posture in which one end of a long side of each banknote is positioned at an inner side of the machine body and a short side thereof is aligned in a horizontal direction (i.e. a lateral direction of the banknote processing machine), and a plurality of banknotes are stacked in the discharge port 13 in a thickness direction in a banknote group SS The discharge port 13 is also configured to receive the entire banknote S having the longest long side. A discharge port shutter 16 for opening/closing an opening of the discharge port 13 and a remaining detection sensor 17 for detecting banknotes S in the discharge port 13 are also installed in the discharge port 13.

A separation release section 19 is installed inside the machine body with respect to in the insertion port 12. The separation release section 19 separates the banknotes S inserted into the insertion port 12 one by one and releases the banknotes S into the machine. The insertion port 12 and the separation release section 19 constitute an insertion section 20 for separating the inserted banknotes S one by one and releasing the banknotes S into the machine while the banknotes S are inserted from the outside of the machine.

A conveyance section 21 is installed inside the machine body with respect to the separation release section 19. The conveyance section 21 conveys the banknotes S released from the separation release section 19. The conveyance section 21 is configured to extend from the separation release section 19 in a rear-up direction, turn toward a lower side, and then extend in a front-down direction, and then further extend horizontally to a front side and finally extend a small distance in a front-up direction to be connected to an upper section behind the discharge port 13.

In addition, the banknote processing machine 11 includes a conveyance section 22, a conveyance path 23, and a conveyance section 24. The conveyance section 22 includes a longitudinal conveyance section 22*a* branching off from midway of the conveyance section 21 and extending straight downward, and a lateral conveyance path 22*b* extending horizontally rearward from a lower end of the longitudinal conveyance section 22*a*. The conveyance path 23 branches off from midway of the longitudinal conveyance section 22*a* of the conveyance section 22, and extends horizontally rearward. The conveyance section 24 branches off from midway of the conveyance section 22 which is lower than the conveyance path 23 of the conveyance section 22, and extends horizontally forward to be connected to the conveyance section 21. The lateral conveyance path 22*b* and the conveyance path 23 guide the banknotes conveyed by a drive force of the longitudinal conveyance section 22*a*, without applying a drive force to the banknotes.

An identification section 28 is installed on an upstream side of the conveyance section 21. The identification section 28 identifies and counts the banknotes S released from an insertion section 20 and conveyed by the conveyance section 21. A temporary storage section 29 is connected to a distal position of the conveyance section 22 via an entrance 29A thereof. The temporary storage section 29 stores banknotes S identified as genuine banknotes by the identification section 28 with mixed denominations so that it can release the banknotes S. A counterfeit banknote collection section (i.e., a receipt section) 30 is connected to a distal position of the conveyance path 23. The counterfeit banknote collection section 30 includes a safe disposed in the machine which receives and collects banknotes S identified as counterfeit banknotes (i.e., abnormal banknotes), other than the genuine banknotes identified by the identification section 28. A counterfeit banknote collection detection sensor 31 is installed at an intermediate position of the conveyance path 23. The counterfeit banknote collection detection sensor 31 detects that the banknotes S identified as counterfeit banknotes are collected into the counterfeit banknote collection section 30.

Banknotes S that are not identified as counterfeit banknotes or as genuine banknotes identified by the identification section 28, for example, unidentifiable banknotes including abnormally conveyed banknotes such as overlapping banknotes, banknotes inserted crookedly, or the like, are conveyed to the discharge port 13 by the conveyance section 21 as they are, and are returned to the customer through the discharge port 13. When the banknotes S received in the temporary storage section 29 are returned, the banknotes S are conveyed toward the discharge port 13 via the conveyance section 22, the conveyance section 24 and the conveyance section 21, to be returned to the customer. For this purpose, the lateral conveyance section 22*a* of the conveyance section 22 conveys the banknotes S toward the temporary storage section 29 during normal rotation, and conveys the banknotes from the temporary storage section 29 in a reverse direction during reverse rotation.

A separation release section 34 is installed inside the machine body with respect to the discharge port 13. The separation release section 34 separates the banknotes S, which are not taken after being discharged to the discharge port 13, to release the banknotes S into the machine one by one. The discharge port 13 and the separation release section 34 constitute one common discharge section (i.e., a first return section, a second return section, and a common return section) 35, which returns the banknotes S unidentified by the identification section 28 to be taken out of the machine, and returns the banknotes S released from the temporary storage section 29 to be taken out of the machine.

A conveyance section 38 is installed inside the machine body with respect to the separation release section 34. The conveyance section 38 conveys the banknotes S, which are released from the separation release section 34 and are not taken in the discharge port 13. A common non-taken banknote collection section (i.e., a receipt section, a first non-taken banknote collection section, and a second non-taken banknote collection section) 39 is connected to a distal position of the conveyance section 38. The common non-taken banknote collection section 39 includes a safe disposed in the machine, which collects and receives the banknotes (i.e., abnormal banknotes) not taken in the common discharge section 35. A non-taken banknote collection detection sensor 40 is installed at an intermediate position of the conveyance section 38. The non-taken banknote collection detection sensor 40 detects that the non-taken banknotes S is collected into the common non-taken banknote collection section 39. The separation release section 34 in the common discharge section 35 is not essential, and a plurality of banknotes S not taken after being discharged to the discharge port 13 may be conveyed to and received in the common non-taken banknote collection section 39 in a bundle.

The banknote processing machine 11 includes a conveyance section 44, a conveyance section 45, and a conveyance section 46. The conveyance section 44 extends slightly downward so as to be connected to the lateral conveyance section 22*a* of the conveyance section 22, and then extends horizontally forward, and finally extends downward. The conveyance section 45 and the conveyance section 46 branch off from the middle of the conveyance section 44 to extend downward. Storage boxes 47 to 49 are connected to distal positions of these conveyance sections 44 to 46. The storage boxes 47 to 49 store the banknotes S released from the temporary storage section 29 by predetermined kinds or with mixed denominations. These storage boxes 47 to 49 constitute a receive section 50 for receiving banknotes S released from the temporary storage section 29.

Figure 2:
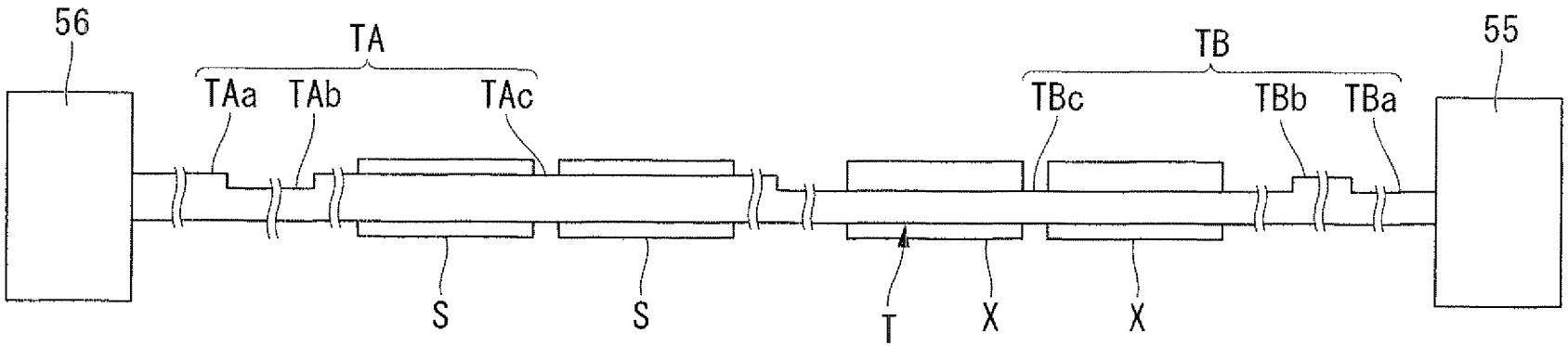
FIG. 2 is a deployment view of major portions of the banknote processing machine in accordance with the first embodiment of the present invention.

In the first embodiment, the temporary storage section 29 releasably receives the banknotes for temporary storage, as well as partition sheets X shown in FIG. 2. The partition sheets X are used to discriminate the banknotes S collected in the counterfeit banknote collection section 30 and the common non-taken banknote collection section 39 upon every processing. For this purpose, by reversing the longitudinal conveyance section 22*a* of the conveyance section 22, the partition sheet X may be taken out of the temporary storage section 29 to be received in the counterfeit banknote collection section 30 along the conveyance path 23, or may be taken out of the temporary storage section 29 to be guided to the discharge port 13 by the conveyance sections 24 and 21. The partition sheet X guided to the discharge port 13 is received in the common non-taken banknote collection section 39 via the conveyance section 38. When the partition sheet X is received in the counterfeit banknote collection section 30, the partition sheet X overlaps with the banknotes S vertically stacked and received in the counterfeit banknote collection section 30 by that time, and is received therewith. When the partition sheet X is received in the common non-taken banknote collection section 39, the partition sheet X overlaps with the banknotes S vertically stacked and received in the common non-taken banknote collection section 39 by that time, and is received therewith.

In the above-mentioned temporary storage section 29, a banknote stack drum (i.e., a drum) 55 is disposed on the side of the entrance 29A, and a tape rewinding drum 56 (i.e., a drum) is disposed on the opposite side to the entrance 29A so that they are parallel to each other. One end of a tape T is fixed to one of the drums, that is, the banknote stack drum 55, and the other end of the tape T is fixed to the other drum, that is, the tape rewinding drum 56 such that only one tape T is placed between the pair of the banknote stack drum 55 and the tape rewinding drum 56. Thus, when the tape T is wound on one of the drums, that is, the banknote stack drum 55, the other drum, that is, the tape rewinding drum 56 is cooperatively rotated via the tape T to release the tape T. On the other hand, when the tape T is wound on the tape rewinding drum 56 on the other side, the banknote stack drum 55 on the one side is cooperatively rotated via the tape T to release the tape T.

The tape T wound on the banknote stack drum 55 extends from a lower section of the banknote stack drum 55 toward the entrance 29A in substantially the same straight direction as the lateral conveyance path 22*b* of a distal end of the conveyance section 22, is downwardly returned by a roller 57 to be guided toward rollers 58 and 59 provided opposite to the entrance 29A, extends in an opposite direction of the entrance 29A, and then, extends upward from the roller 59 to be wound on the tape rewinding drum 56. At this time, the tape T is wound on the tape rewinding drum 56 to extend downward from the side of the entrance 29A of the tape rewinding drum 56.

During temporary storage of the banknotes S, the banknotes S separated and conveyed one by one by the conveyance section 22 are conveyed from the lateral conveyance path 22*b* to the entrance 29A of the temporary storage section 29 at a predetermined speed by a conveyance drive force of the longitudinal conveyance section 22*a*. Here, since the tape rewinding drum 56 and the banknote stack drum 55 are rotated in a predetermined banknote receipt direction (i.e., in a counterclockwise direction as shown in FIG. 1), the banknotes S withdrawn from the conveyance section 22, as shown in FIG. 2, overlap the tape T at the intermediate position in the short-side direction to be wound on a portion of the tape T already wound on the banknote stack drum 55 along with the tape T, and thereby are sandwiched within the tape T. The banknotes S sequentially conveyed into the temporary storage section 29 are wound on the banknote stack drum 55 with the tape T as described above, and thereby are received on the banknote stack drum 55 in a stacked state. In this manner, the tape T is wound on the banknote stack drum 55 while being released from the tape rewinding drum 56, so that the banknotes S conveyed from the conveyance section 22 are received in the temporary storage section 29 (see FIG. 3A). This is a winding operation.

On the other hand, when the tape rewinding drum 56 and the banknote stack drum 55 are rotated in a reverse direction with respect to the above-mentioned direction, that is, in a predetermined banknote release direction (i.e., in a clockwise direction in FIG. 1), the banknotes S stacked on the banknote stack drum 55 are separated and released from the banknote stack drum 55 with the overlapped portion of the tape T such that the banknotes S are separated from the tape T at the entrance 29A of the temporary storage section 29 to be released to the conveyance section 22. In this way, only the tape T is rewound on the tape rewinding drum 56 with the tape T being released from the banknote stack drum 55, and the banknotes S received on the banknote stack drum 55 are conveyed to the conveyance section 22 from the temporary storage section 29 (see FIG. 3B). This is a rewinding operation.

As described above, by performing the winding operation and the rewinding operation of the tape T between the banknote stack drum 55 and the tape rewinding drum 55, stacked storage and separated insertion of the banknotes S introduced one by one are performed. Both ends of the tape T (i.e., an initial end and a terminal end) are correspondingly attached to outer peripheries of the banknote stack drum 55 and the tape rewinding drum 56, respectively, by attachment members (not shown) and then the tape T is wound thereon.

When the banknotes S in the temporary storage section 29 are conveyed to the receipt section 50 shown in FIG. 1, the longitudinal conveyance section 22*a* of the conveyance section 22 and the conveyance section 44 are rotated at a similar predetermined speed as described above such that the banknotes S released from the temporary storage section 29 are conveyed toward the receipt section 50 via the conveyance sections 44 to 46. Meanwhile, when the banknotes S in the temporary storage section 29 are returned to the common discharge port 35, the longitudinal conveyance section 22*a* of the conveyance section 22 is driven in a reversed direction with respect to the above-mentioned direction at a similar predetermined speed as described above, so that the banknotes S released from the temporary storage section 29 are conveyed toward the common discharge section 35 via the conveyance sections 22, 24 and 21.

In the first embodiment, as described above, the temporary storage section 29 releasably receives the banknotes S for temporary storage, and it releasably receives the partition sheet X shown in FIG. 2 used for discriminating the banknotes S in the counterfeit banknote collection section 30 and the common non-taken banknote collection section 39 whenever each process is performed. For this reason, the tape T has a tape section TA for banknotes and a tape section TB for partition sheets. The tape section TA for banknotes is a predetermined portion of the tape T at a fixed end side of the tape rewinding drum 56. The tape section TB for partition sheets is a predetermined portion of the tape T at a fixed end side of the banknote stack drum 55. In order to increase the number of banknotes S temporarily received in the temporary storage section 29, the tape section TB for partition sheets is provided near any one of both ends of the tape T, particularly, near the banknote stack drum 55 side end. The length of the tape T is determined in consideration of the limit to the number of the banknotes S estimated as the number of temporary storage banknotes in the temporary storage section 29 and the number of pre-loading partition sheets X estimated as the number of pre-received partition sheets.

The tape section TA for banknotes is a portion for receiving the banknotes S, and has a winding end region TAa, a winding near-end region TAb, and a banknote receiving region TAc. The winding end region TAa has a large width and is a predetermined portion of the tape section TA including an end fixed to the tape rewinding drum 56. The winding near-end region TAb has a small width and is a predetermined portion of the tape section TA opposite to the end of the winding end region TAa fixed to the tape rewinding drum 56 with respect to the winding end region TAa. The banknote receiving region TAc has a large width and is a predetermined portion of the tape section TA opposite to the winding end region TAa with respect to the winding near-end region TAb.

The tape section TB for partition sheets is a portion for receiving partition sheets X different from the banknotes S, and has a rewinding end region TBa, a rewinding near-end region TBb, and a partition sheet receiving region TBc. The rewinding end region TBa has a small width and is a predetermined portion of the tape section TB including an end fixed to the banknote stack drum 55. The rewinding near-end region TBb has a large width and is a predetermined portion of the tape section TB opposite to the end of the rewinding end region TBa fixed to the banknote stack drum 55 with respect to the rewinding end region TBa. The partition sheet receiving region TBc has a small width and is a predetermined portion of the tape section TB opposite to the rewinding end region TBa with respect to the rewinding near-end region TBb. The partition sheet receiving region TBc is adjacent to the banknote receiving region TAc of the tape section TA for banknotes. The large widths of the winding end region TAa, the banknote storage region TAc, and the rewinding near-end region TBb are equal to each other. The small widths of the winding near-end region TAb, the partition sheet storage region TBc and the rewinding end region TBa are equal to each other. The regions TAa to TAc and TBa to TBc of the tape T may have different widths.

As shown in FIG. 1, a region identification sensor 62 is installed adjacent to the banknote stack drum 55. The region identification sensor 62 detects a difference in width of the tape T at a position of the entrance path extending from the banknote stack drum 55 toward the entrance 29A so as to form substantially the same straight line as the lateral conveyance path 22*b*, thereby detecting the respective regions TAa to TAc and TBa to TBc of the tape T. That is, as shown in FIG. 2, since the regions TAa to TAc and TBa to TBc of the tape T are adjacent to each other and have different widths, the region identification sensor 62 detects boundary positions of the regions adjacent to each other and having different widths.

Figure 3A:
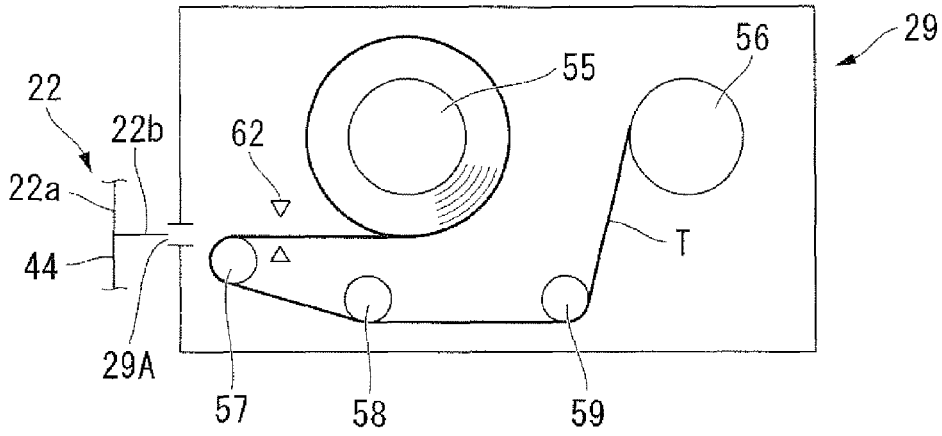
FIG. 3A is an enlarged side view of major portions of the banknote processing machine in accordance with the first embodiment of the present invention.

A state in which the tape T is maximally released from the banknote stack drum 55 to be maximally wound on the tape rewinding drum 56 is referred to as a rewinding end state. Specifically, by this rewinding operation, in the rewinding end state, the region identification sensor 62 detects the boundary position of the tape T between the rewinding end region TBa having the small width and the rewinding near-end region TBb having the large width. In this state, when the winding operation is performed, the region identification sensor 62 detects the rewinding near-end region TBb having the large width, and then, detects the partition sheet storage region TBc having the small width. In this way, the tape section TB for partition sheets is wound on the banknote stack drum 55. Afterwards, the region identification sensor 62 detects the boundary position between the partition sheet storage region TBc having the small width and the banknote receiving region TAc having the large width. Continuously, during detection of the banknote receiving region TAc having the large width, the banknote receiving region TAc of the tape section TA for banknotes is wound on the banknote stack drum 55. When the boundary position between the banknote receiving region TAc having the large width and the winding near-end region TAb having the small width is detected by the region identification sensor 62, the tape section TA for banknotes is at the near-end position. Next, when the boundary position between the winding near-end region Tab having the small width and the winding end region TAa having the large width is detected by the region identification sensor 62, the tape section TA for banknotes is at the end position. As a result, as shown in FIG. 3A, the tape T sets to a winding end state in which the tape T is maximally released from the tape rewinding drum 56 to be maximally wound on the banknote stack drum 55.

Figure 3B:
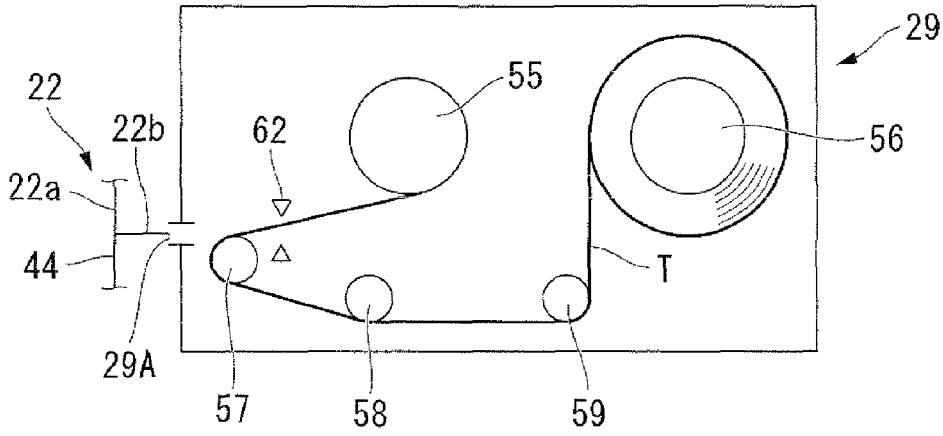
FIG. 3B is an enlarged side view of the major portions of the banknote processing machine in accordance with the first embodiment of the present invention.

A state in which the tape T is maximally released from the tape rewinding drum 56 to be maximally wound on the banknote stack drum 55 is referred to as a winding end state. By this winding operation, in the winding end state, as described above, the region identification sensor 62 detects the boundary position of the tape T between the winding end region TAa having the large width and the winding near-end region TAb having the small width. In this state, when the rewinding operation is performed, the region identification sensor 62 detects the winding near-end region TAb having the small width, and then, detects the banknote receiving region TAc having the large width. In this way, the tape section TA for banknotes is wound on the tape rewinding drum 56. Afterwards, the region identification sensor 62 detects a boundary position between the banknote receiving region TAc having the large width and the partition sheet receiving region TBc having the small width. Continuously, during detection of the partition sheet receiving region TBc having the small width, the partition sheet receiving region TBc of the tape section TB for partition sheets is wound on the tape rewinding drum 56. When the boundary position between the partition sheet receiving region TBc having the small width and the rewinding near-end region TBb having the large width is detected by the region identification sensor 62, the tape section TB for partition sheets is at the near-end position. Next, when the boundary position between the rewinding near-end region TBb having the large width and the rewinding end region TBa having the small width is detected by the region identification sensor 62, the tape section TB for partition sheets is at the end position. As a result, as shown in FIG. 3B, the tape T is set to a rewinding end state in which the tape T is maximally released from the banknote stack drum 55 to be maximally wound on the tape rewinding drum 56.

As described above, in the tape section TB for partition sheets and the tape section TA for banknotes, which is the other tape section, are distinguished from each other due to the difference in width at the boundary position (i.e., a discrimination section) since widths of the partition sheet storage region TBc and the banknote storage region TAc are different from each other. The boundary positions between the respective regions TAa to TAc and TBa to TBc, at which the width of the tape T varies, are not the position at which all of the banknotes S and the partition sheets X are maintained. Therefore, it is possible not to hinder the boundary positions between the respective regions TAa to TAc and TBa to TBc from being detected by the region identification sensor 62 due to the banknotes S or the partition sheets X. The region identification sensor 62 also detects introduction and discharge of the banknotes S and the partition sheets X wider than the tape T into/from the banknote stack drum 55, in addition to the detection of the width of the tape T.

Discrimination of the winding end region TAa, the winding near-end region TAb, the banknote receiving region TAc, the partition sheet storage region TBc, the rewinding near-end region TBb and the rewinding end region TBa, including discrimination of the tape section TB for partition sheets and the tape section TA for banknotes, is not limited to the difference in width of the tape. This discrimination may be performed using a difference in color, a difference in transmittance of light, a difference in design, and so on. In this case, region identification sensors corresponding thereto are employed.

As described above, the tape section TA for banknotes is wound on the banknote stack drum 55 with the banknotes S so as to receive the banknotes one by one, and is released from the banknote stack drum 55 so as to release the banknotes S one by one received on the banknote stack drum 55. The banknote receiving region TAc for receiving the banknotes S has such a length that the predetermined number of banknotes S can be received at predetermined intervals set by a conveyance speed of the conveyance section 22. The temporary storage section 29 normally releases only the tape section TA for banknotes from the banknote stack drum 55.

The tape section TB for partition sheets is wound on the banknote stack drum 55 along with the partition sheets X, which are different from the banknotes S so as to sequentially receive the partition sheets X one by one, and is released from the banknote stack drum 55 so as to sequentially release the received partition sheets X from the banknote stack drum 55 one by one. In other words, the temporary storage section 29 winds and releasably receives at least one partition sheet X on one of the drums, that is, the banknote stack drum 55 along with the tape section TB for partition sheets of the tape T. The tape section TB for partition sheets is provided at the fixed end side of the tape T fixed to the banknote stack drum 55 with respect to the tape section TA for banknotes for receiving the banknote S. The partition sheet receiving region TBc for receiving the partition sheet X has such a length that the predetermined number of partition sheets X can be received at predetermined intervals set by a conveyance speed of the conveyance section 22. The tape section TB for partition sheets TB is normally kept wound on the banknote stack drum 55, and only when necessary, released from the banknote stack drum 55.

The partition sheets X have a long-side length and a short-side length, clearly distinguished from the banknotes S, within a range appropriate for processing in the banknote processing machine 11. The partition sheets X readably store information by which they can be identified as the partition sheets X by the identification section 28. For example, the partition sheets X may be provided with identification management numbers 1, 2, 3, 4, 5, . . . , and so on, that can be read by the identification section 28.

As shown in FIG. 1, the banknote processing machine 11 includes a control section 65, a storage section 66, a display 67, a sound generator 68, an operation section 69, and a communication section 70. The control section 65 controls operations of the banknote processing machine 11. The storage section 66 stores information. The display 67 displays images to an operator. The sound generator 68 provides sound output to the operator. The operation section 69 receives operation inputs from the operator. The communication section 70 communicates with the outside. The control section 65 receives signals from the identification section 28, the insertion detection sensor 15, the remaining detection sensor 17, the counterfeit banknote detection sensor 31, the non-taken banknote collection sensor 40, the region identification sensor 62, and so on, and controls the respective sections.

The operations of the banknote processing machine 11 according to the first embodiment as described above will be described. In the insertion port shutter 14A, a closed state is a standby state, and in the discharge port shutter 16, a closed state is a standby state. In the temporary storage section 29*a* state in which a boundary position between the tape section TA for banknotes and the tape section TB for partition sheets of the tape T, i.e., a boundary position between the banknote receiving region TAc and the partition sheet receiving region TBc is detected by the region identification sensor 62 and the tape section TB for partition sheets of the tape T is wound on the banknote stack drum 55, is a standby state.

[Partition Sheet Restock Mode]

A partition sheet restock process mode is a mode of receiving the partition sheets X in the temporary storage section 29, which is, for example, performed at a preparation step for starting daily tasks. When the partition sheet restock process mode is selected by the operation section 69, the control section 65 performs a partition sheet restock process. That is, first, it is determined from information in the storage section 66 whether the partition sheets X in the temporary storage section 29 are in a maximum received state, are in a state in which the partition sheets X are not in the maximum received state, or are in a state in which no partition sheets X are present. When the partition sheets X in the temporary storage section 29 are in the maximum storage state, the control section 65 reports the maximum received state of the partition sheets X using the display 67 and the sound generator 68 to complete the current partition sheet restock process mode.

The case in which the partition sheets X remain in the temporary storage section 29 in the state in which the partition sheets X are not in the maximum received state will be described. In this case, the control section 65 opens the insertion port shutter 14 to open the insertion port 12, and displays an indication through the display 67 to demand input of the partition sheets X. In addition, the control section 65 performs a rewinding operation on the banknote stack drum 55, the tape T and the tape rewinding drum 56. The control section 65 stops the banknote stack drum 55, the tape T, and the tape rewinding drum 56 when an end of one of the partition sheets X on a release side is detected by the region identification sensor 62.

The case in which there is no remaining number of partition sheets X will be described. In this case, the control section 65 opens the insertion port shutter 14 to open the insertion port 12, and displays an indication through the display 67 to demand input of the partition sheets X. In addition, the control section 65 performs a rewinding operation on the banknote stack drum 55, the tape T, and the tape rewinding drum 56. The control section 65 stops the banknote stack drum 55 and the tape rewinding drum 56 when the tape is set to the rewinding end state shown in FIG. 3B. The control section 65 rotates the banknote stack drum 55 and the tape rewinding drum 56 at a high speed until the region identification sensor 62 detects the boundary position between the partition sheet receiving region TBc having the small width and the rewinding near-end region TBb having the large width during the rewinding operation. When the boundary position is detected, the control section 65 switches a speed of the banknote stack drum 55 and the tape rewinding drum 56 to a low speed. Finally, when the boundary position between the rewinding near-end region TBb having the large width and the rewinding end region TBa having the small width is detected, the control section 65 stops the banknote stack drum 55, the tape T and the tape rewinding drum 56. The control section 65 always performs this control when conducting the rewinding operation.

Figure 3C:
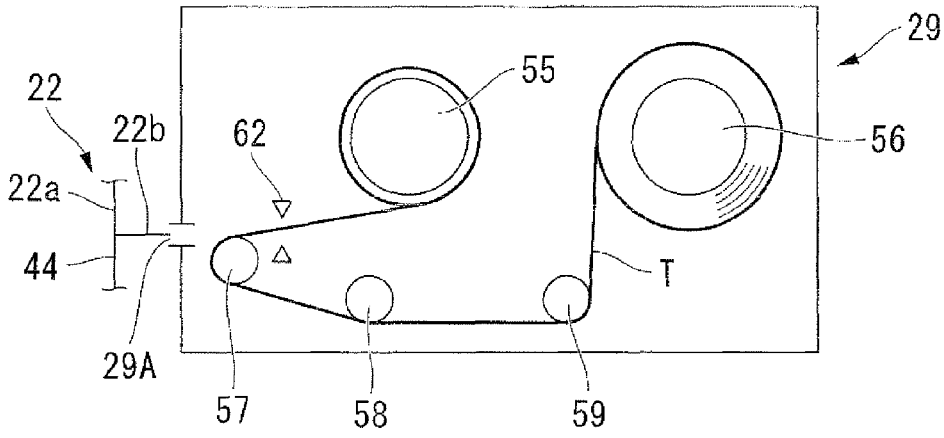
FIG. 3C is an enlarged side view of the major portions of the banknote processing machine in accordance with the first embodiment of the present invention.

When the insertion port 12 is opened as described above, an operator inserts one partition sheet X or a plurality of partition sheets X into the insertion port 12. When the plurality of partition sheets X are inserted, the operator inserts the partition sheets X in a state in which the partition sheets X are aligned in long- and short-side directions and stacked in a thickness direction. When a process start order is input into the operation section 69 in a state in which the insertion detection sensor 15 detects the partition sheet X, the control section 65 closes the insertion port shutter 14. Next, provided that the banknote stack drum 55, the tape T, and the tape rewinding drum 56 are in the above-mentioned stop state, the control section 65 drives the separation release section 19 and the conveyance sections 21 and 22 in a normal rotation direction. Then, the partition sheets X in the insertion port 12 are separated one by one at the separation release section 19 to be released to the conveyance section 21, identified by the identification section 28, and conveyed to the conveyance sections 21 and 22 while storing the identification management numbers. Then, on the basis of the detection timing of the partition sheet X by the identification section 28, the winding operation of the banknote stack drum 55, the tape T, and the tape rewinding drum 56 of the temporary storage section 29 is performed to sequentially receive the partition sheets X at predetermined intervals. That is, the partition sheets X are sequentially wound on the rotating banknote stack drum with the partition sheet receiving region TBc of the tape T at predetermined intervals. Then, after the predetermined number of partition sheets X are received, when the boundary position between the tape section TB for partition sheets and the tape section TA for banknotes, i.e., the boundary position between the partition sheet receiving region TBc having the small width of and the banknote receiving region TAc having the large width is detected by the region identification sensor 62, the control section 65, as shown in FIG. 3C, temporarily stops the banknote stack drum 55, the tape T, and the tape rewinding drum 56 to cause the temporary storage section 29 to set to a standby state.

The identification section 28 counts the number of partition sheets X while the partition sheet restock process is carried out. When the identification section 28 detects the partition sheets X exceeding the predetermined number of the partition sheets X that can be received within the range of the partition sheet receiving region TBc, the control section 65 discharges the last detected partition sheet and the following partition sheets X from the discharge port 13 to the conveyance section 21. In addition, the control section 65 also discharges the partition sheets X that cannot be identified by the identification section 28 to the discharge section 13. When the number of the partition sheets X conveyed to the temporary storage section 29 are less than the maximum number of the partition sheets X receivable in the temporary storage section 29, only the partition sheets X conveyed to the temporary storage section 29 are received on the banknote stack drum 55. Then, during the partition sheet restock process, when the insertion detection sensor 15 detects that there is no partition sheet X in the insertion section 12, the control section 65 stops the separation release section 19, and then, stops the conveyance sections 21 and 22 when the conveyance of all of the partition sheets X to any one corresponding to the temporary storage section 29 and the discharge port 13 is completed.

If there is a partition sheet X discharged to the discharge port 13 during the partition sheet restock process, the control section 65 opens the discharge port shutter 16 to open the discharge port 13 after stopping the conveyance sections 21 and 22, and at the same time, performs visible display and audible output urging removal of the partition sheet X through the display 67 and the sound generator 68. When the remaining detection sensor 17 detects no partition sheet X, the discharge port shutter 16 is closed to close the discharge port 13, completing the current partition sheet restock process mode.

Meanwhile, if there is no partition sheet X discharged in the discharge port 13 during the partition sheet restock process, the control section 65 stops the conveyance sections 21 and 22 upon completion of conveyance of all of the partition sheets X to the temporary storage section 29. As described above, when the boundary position between the tape section TB for partition sheets and the tape section TA for banknotes, which is detected after the predetermined number of partition sheets X is received, is detected by the region identification sensor 62 to stop the banknote stack drum 55 and the tape rewinding drum 56 to set to a standby state, the current partition sheet restock process mode is completed.

[Deposit Process Mode (Normal Process Mode)]

When a deposit process mode of a normal process mode for depositing banknotes S into the banknote processing machine 11 is selected and input into an operation section 69, the control section 65 performs a deposit process. That is, first, the insertion port shutter 14 is opened to open the insertion port 12, and an indication requesting insertion of the banknotes S is displayed through the display 67. When the insertion port 12 is opened as described above, the operator inserts one or a plurality of banknotes S into the insertion port 12. When the plurality of banknotes S are inserted, the operator inserts the banknotes S into the insertion port 12 in a state of a banknote group SS in which the banknotes S are aligned in long- and short-side directions and stacked in a thickness direction. When a command to start the deposit process is input into the operation section 69 in a state in which the banknotes S are detected by the insertion detection sensor 15, the control section 65 closes the insertion port shutter 14 to close the insertion port 12. Next, the control section 65 drives the separation release section 19 and the conveyance sections 21 and 22 in a normal rotation direction to cause the banknotes S in the insertion port 12 to be separated one by one by the separation release section 19, to be released to the conveyance section 21, and to be identified by the identification section 28.

Then, the banknotes S identified as genuine banknotes by the identification section 28 are conveyed to the temporary storage section 29 via the conveyance sections 21 and 22. The banknotes S identified as counterfeit banknotes by the identification section 28 are conveyed to the counterfeit banknote collection section 30 via the conveyance sections 21, 22 and 23. The banknotes S identified as unidentifiable banknotes by the identification section 28 are conveyed toward the discharge port 13 via the conveyance section 21 as they are.

The banknotes S conveyed to the temporary storage section 29 are wound on the banknote stack drum 55 with the tape T to be sequentially received in the temporary storage section 29. That is, a winding operation of the banknote stack drum 55, the tape T, and the tape rewinding drum 56 is performed in synchronization with the detection timing of the identification section 28, and the banknotes S are sequentially wound and received on the rotating banknote stack drum 55 at predetermined intervals along with the banknote storage region TAc of the tape T. When the insertion detection sensor 15 detects that the banknotes S in the insertion port 12 are gone, the control section 65 stops the separation release section 19. Then, when the banknote S finally identified as a genuine banknote by the identification section 28 is received in the temporary storage section 29, the control section 65 stops the banknote stack drum 55, the tape T, and the tape rewinding drum 56 (see FIG. 3A). In addition, the control section 65 stops the conveyance sections 21 and 22 upon completion of conveyance of all of the inserted banknotes S to any one of the temporary storage section 29, the counterfeit banknote collection section 30, and the discharge port 13. Then, the control section 65 stores the identified results of the identification section 28 at the current process in the storage section 66, and displays the results through the display 67. When there are banknotes S discharged to the discharge port 13 during the deposit process, the control section 65 opens the discharge port shutter 16 to open the discharge port after stopping the conveyance sections 21 and 22, and performs visible display and audible output urging removal of the banknotes S through the display 67 and the sound generator 68.

After confirmation of the identified results displayed on the display 67, when the operator inputs an approval operation to the operation panel 69, the control section 65 begins a receipt process of the deposit process. In the deposit process, the conveyance sections 44 to 46 are normally driven, and the control section 65 causes the temporary storage section 29 to perform the winding operation to sequentially release the banknotes S wound on the banknote stack drum 55 along with the banknote storage region TAc of the tape T. Then, the banknotes S released from the temporary storage section 29 are distributed to and received in the corresponding receipt boxes 47 to 49 on the basis of the identification information stored in the storage section 66 or in a batch. During the rewinding operation of the temporary storage section 29, when the boundary position between the tape section TA for banknotes and the tape section TB for partition sheets is detected by the region identification sensor 62, the control section 65 stops the banknote stack drum 55, the tape T, and the tape rewinding drum 56, as shown in FIG. 3C. At this time, the partition sheet X of the temporary storage section 29 is kept received on the banknote stack drum 55.

When all of the banknotes S are released from the temporary storage section 29 to be received in the corresponding storage boxes 47 to 49, the control section 65 stops the conveyance sections 44 to 46, and determines whether there is a banknote S identified as a counterfeit banknote by the identification section 28 during the present deposit process and whether there is a banknote S identified as an unidentified banknote by the identification section 28 during the present deposit process.

During the present deposit process, when there is no banknote S identified as a counterfeit banknote or identified as an unidentified banknote, the control section 65 completes the current deposit process mode. During the deposit process, when there is a banknote S identified as a counterfeit banknote and there is no banknote S identified as an unidentifiable banknote, the control section 65 performs only partition sheet distribution operation for counterfeit banknotes as described below, and then completes the current deposit process mode. During the deposit process, when there are banknotes S identified as a counterfeit banknote and an unidentifiable banknote, the control section 65 performs counterfeit banknote partition sheet distribution operation, performs non-taken banknote determination, as described below, and, if necessary, a partition sheet distribution operation for non-taken banknotes according to the results thereof, and then, completes the deposit process mode. During the current deposit process, when there is no banknote S identified as a counterfeit banknote and there is a banknote identified as an unidentifiable banknote, the control section 65 performs non-taken banknote determination as described below and, if necessary, the non-taken banknote partition sheet distribution operation according to the results thereof, and completes the deposit process mode.

[Counterfeit Banknote Partition Sheet Distribution Operation (Abnormality Process Operation)]

At the beginning of the counterfeit banknote partition sheet distribution operation, which is an abnormality process operation, the control section 65 drives the conveyance section 22 in a reverse direction, and performs the rewinding operation of the banknote stack drum 55, the tape T and the tape rewinding drum 56 of the temporary storage section 29 in the standby state to release one partition sheet X to convey it to the counterfeit banknote collection section 30 via the conveyance section 22 and the conveyance path 23. When the region identification sensor 62 detects that one partition sheet X was released from the banknote stack drum 55, the control section 65 returns the banknote stack drum 55, the tape T and the tape rewinding drum 56 to the standby state. At this time, the next and the subsequent partition sheets X after the released partition sheet X are kept in a received state on the banknote stack drum 55. When the counterfeit banknote collection detection sensor 31 detects that the partition sheet X was received in the counterfeit banknote collection section 30, the control section 65 stops the conveyance section 22. In addition, the control section 65 stores the identification management number of the partition sheet X, which was previously identified by the identification section 28 and stored in the storage section 66, in the storage section 66 in relation to the process identification number of the deposit process (or counting process described below) including the present counterfeit banknote partition sheet distribution operation, thereby completing the counterfeit banknote partition sheet distribution operation.

Accordingly, the partition sheet X is disposed on one or more banknotes S identified as counterfeit banknotes and forcedly collected in the counterfeit banknote collection section 30 through the above process, and thus, the banknotes S forcedly collected in the counterfeit banknote collection section 30 through the following process are disposed on the partition sheet X to be discriminated therefrom. That is, since the partition sheet X is overlapped on the banknotes S identified as counterfeit banknotes whenever the counterfeit banknote partition sheet distribution operation is performed, the banknotes S are partitioned by the partition sheets X, and thereby the banknotes S are discriminated whenever the counterfeit banknote partition sheet distribution operation is performed. In other words, the banknotes S are discriminated per process including the counterfeit banknote partition sheet distribution operation. Therefore, after completion of the service, these banknotes are removed from the counterfeit banknote collection section 30 in a stacked state as they are, so that the banknotes S can be discriminated per process.

[Non-Taken Banknote Determination]

The control section 65 detects the presence of the banknotes S using the remaining detection sensor 17 of the discharge port 13. When the banknotes S are not detected by the remaining detection sensor 17, the control section 65 closes the discharge port shutter 16 in an open state to complete the process without performing the non-taken banknote partition sheet distribution operation. When the remaining detection sensor 17 detects the banknotes S, the control section 65 stands by for a predetermined time, and when the remaining detection sensor 17 does not detect the banknotes S before the predetermined time has elapsed, the control section 65 closes the discharge port shutter 16 to complete the process without performing the non-taken banknote partition sheet distribution operation. When the remaining sensor 17 detects the banknotes S even after the predetermined time has elapsed, the control section 65 determines that a user has failed to take some or all of the banknotes S, and performs the non-taken banknote partition sheet distribution operation as described below.

[Non-Taken Banknote Partition Sheet Distribution Operation (Abnormality Process Operation)]

At the beginning of the non-taken banknote partition sheet distribution operation, which is an abnormality process operation, the control section 65 closes the discharge port shutter 16, normally drive the separation release section 34 and the conveyance section 38 to cause the banknotes S in the discharge port 13 as the non-taken banknotes S to be stored in the common non-taken banknote collection section 39. When the remaining detection sensor 17 and the non-taken banknote collection detection sensor 40 detect that all of the banknotes S in the discharge port 13 have been received in the common non-taken banknote collection section 39, the control section 65 stops the separation release section 34 and the conveyance section 38. Along with this, the control section 65 drives the conveyance section 22 in a reverse direction, drives the conveyance sections 21 and 24 in a normal direction, and performs an additional rewinding operation of the temporary storage section 29 to discharge one partition sheet X to the discharge port 13 via the conveyance sections 22, 24 and 21. When the region identification sensor 62 detects that one partition sheet X was released from the banknote stack drum 55 by the rewinding operation of the temporary storage section 29, the control section 65 returns the banknote stack drum 55, the tape T, and the tape rewinding drum 56 to the standby state. Then, when the remaining detection sensor 17 detects that the partition sheet X was discharged to the discharge port 13, the control section 65 stops the conveyance sections 22, 24 and 21, and normally drives the separation release section 34 and the conveyance section 38 to cause the partition sheet X in the discharge section 13 to be received into the common non-taken banknote collection section 39. When the remaining detection sensor 17 and the non-taken banknote collection detection sensor 40 detect that the partition sheet X in the discharge port 13 was received in the common non-taken banknote collection section 39, the control section 65 stops the separation release section 34 and the conveyance section 38, and, stores the identification management number of the partition sheet X, which was previously identified by the identification section 28 and stored in the storage section 66, in the storage section 66 in relation to the process identification number of the deposit process (or the counting process or the withdrawal process discussed below) including the current non-taken banknote partition sheet distribution operation, thereby completing the non-taken banknote partition sheet distribution operation.

Accordingly, the partition sheet X is disposed on one or more non-taken banknotes S identified and forcedly collected to the common non-taken banknote collection section 39 through the current process, so that the non-taken banknotes S provided through the following process are disposed on the partition sheet X to be discriminated therefrom. That is, since the partition sheet X is overlapped on the non-taken banknotes S whenever the non-taken banknote partition sheet distribution operation is performed, the non-taken banknotes S are partitioned by the partition sheets X, and thereby are discriminated whenever the non-taken banknote partition sheet distribution operation is performed. In other words, the non-taken banknotes S are discriminated per process including the non-taken banknote partition sheet distribution operation. Therefore, after completion of the service, the banknotes S can be discriminated by removing them from the common non-taken collection section 39 in a stacked state as they are per process. In a series of non-taken banknote partition sheet distribution operations in which the partition sheets X are conveyed from the temporary storage section 29 to the common non-taken banknote collection section 39, the discharge port shutter 16 is maintained in a closed state, and the discharge port 13 is also in a closed state.

When both of the counterfeit banknote partition sheet distribution operation and the non-taken banknote partition sheet distribution operation are performed in relation to one process, the temporary storage section 29 may not be returned to the standby state until a first partition sheet X is released and then a second partition sheet X is released.

After confirmation of the results identified by the deposit process displayed through the display 67 as described above, when an operator inputs a cancel order into the operation section 69, the control section 65 starts a return process of the deposit process. Here, when the discharge port shutter 16 is closed, the control section 65 starts the return process in this state, whereas, when the discharge port shutter 16 is open, the control section 65 starts the return process after closing the discharge port shutter 16. In the return process, the conveyance section 22 is driven in a reverse direction, the conveyance sections 21 and 24 are driven in a normal direction, and the rewinding operation is performed on the banknote stack drum 55, the tape T, and the tape rewinding drum 56 of the temporary storage section 29, so that the banknotes S wound on the banknote stack drum 55 along with the banknote receiving region TAc of the tape T are sequentially released. As a result, all of the banknotes S released from the temporary storage section 29 are discharged to the discharge port 13. During the rewinding operation of the temporary storage section 29, when the region identification sensor 62 detects the boundary position between the tape section TA for banknotes and the tape section TB for partition sheets, the control section 65 stops the banknote stack drum 55, the tape T and the tape rewinding drum 56. At this time, the partition sheets X in the temporary storage section 29 are kept received on the banknote stack drum 55.

Then, when all of the banknotes S are released from the temporary storage section 29 and discharged to the discharge port 13, the control section 65 stops the conveyance sections 21, 22 and 24, and opens the discharge port shutter 16. Then, the control section 65 performs the non-taken banknote determination. As a result, when the banknotes S are detected by the remaining detection sensor 17 even when a predetermined time has elapsed, the non-taken banknote partition sheet distribution operation is performed.

[Counting Process Mode (Normal Process Mode)]

When the counting process mode of a normal process mode of counting and returning the banknotes S at the banknote processing machine 11 is selected and input into the operation section 69, the control section 65 performs a counting process. That is, similar to the deposit process, first, the insertion port shutter 14 is opened to open the insertion port 12, and an indication requesting insertion of the banknotes S is displayed through the display 67. When a process start order is input into the operation panel 69 in a state in which the banknotes S are detected by the insertion detection sensor 15, the control section 65 closes the insertion port shutter 14 to close the insertion port 12. Next, the control section 65 normally drives the separation release section 19 and the conveyance sections 21 and 22 to cause the banknotes S in the insertion section 12 to be separated one by one by the separation release section 19, to be released to the conveyance section 21, and to be identified by the identification section 28. Then, the banknotes S identified as genuine banknotes by the identification section 28 are conveyed toward the discharge port 13 via the conveyance section 21 as they are. The banknotes S identified as counterfeit banknotes by the identification section 28 are conveyed to the counterfeit banknote collection section 30 via the conveyance section 21 and the conveyance path 23. The banknotes S identified as unidentifiable banknotes by the identification section 28 are conveyed toward the discharge port 13 via the conveyance section 21 as they are.

When the insertion detection sensor 15 detects that the banknotes S in the insertion port 12 are gone, the control section 65 stops the separation release section 19, and stops the conveyance sections 21 and 22 upon completion of the conveyance of all of the inserted banknotes S to the corresponding one of the counterfeit banknote collection section 30 and the discharge port 13. When there is no unidentifiable banknote during the current counting process, the control section 65 stores the identification results of the identification section 28 in the storage section 66 in relation to a process identification number of the current counting process, and displays the results through the display 67. Meanwhile, when there is an unidentifiable banknote, identification information of the counterfeit banknote is linked to the process identification number of the counting process, and is stored in the storage section 66 only when there is a counterfeit banknote; and when there is an unidentifiable banknote and there is no counterfeit banknote, the identified results of the identification section 28 are not stored in the storage section 66. Then, when there is an unidentifiable banknote, the control section 65 controls the display 67 to display the reason that the counting is improperly performed.

After stopping the conveyance sections 21 and 22, the control section 65 opens the discharge port shutter 16 to open the discharge port 13, and performs display and sound output urging removal of the banknotes S through the display 67 and the sound generator 68.

Next, during the current counting process, when there is a banknote S identified as a counterfeit banknote by the identification section 28, the counterfeit banknote partition sheet distribution operation is performed, and then, the non-taken banknote determination is performed. As a result, when the banknotes S are detected by the remaining detection sensor 17 even when a predetermined time has elapsed, the non-taken banknote partition sheet distribution operation is performed, and then, the current counting process mode is completed.

During the counting process, when there is no banknote S identified as a counterfeit banknote by the identification section 28, the non-taken banknote determination is performed. As a result, when the banknotes S are detected by the remaining detection sensor 17 even when a predetermined time has elapsed, the non-taken banknote partition sheet distribution operation is performed, and then, the current counting process mode is completed.

As described operation, the control section 65 recognizes the number of partition sheets X received in the temporary storage section 29 and the number of partition sheets X released during the present process from the detection results by the region identification sensor 62. On the basis of these numbers, the control section 65 determines whether the temporary storage section 29 lacks the partition sheets X, after each of the deposit process mode and the counting process mode (and withdrawal process mode discussed below) is performed.

Here, no partition sheet X may be present in the temporary storage section 29. Even in this case, when the partition sheet X is at a final position (the uppermost position) of receipt, each of the counterfeit banknote collection section 30 and common non-taken banknote collection section 39 can discriminate the banknotes S from the banknotes S received through the previous process even when the banknotes S are received only one time in the future. For this reason, during execution of one of the deposit process mode and the counting process mode (and the withdrawal mode described below), even when there is no partition sheet X in the temporary storage section 29, the control section 65 receives the banknotes S into at least one of the counterfeit banknote collection section 30 and the common non-taken banknote collection section 39 to perform smooth service management. In this case, the identification management number of the partition sheet X stored in the storage section 66 in relation to the process identification number of this process is temporarily stored as "no sheet."

Therefore, in the current process (the deposit process or the counting process (or the withdrawal process described below)), the control section 65 determines that the temporary storage section 29 lacks the partitions sheets X only when the partition sheets X cannot be distributed after the banknotes S are received in at least one of the counterfeit banknote collection section 30 and the common non-taken banknote collection section 39. For this reason, even without strictly managing the number of the partition sheets X received in the temporary storage section 29, when the rewinding operation of the temporary storage section 29 is performed in order to release the partition sheet X and the region identification sensor 62 detects the rewinding near-end region TBb or the rewinding end region TBa and does not detect the partition sheet X, it may be possible to determine that the partition sheets X are insufficient.

After execution of the deposit process mode and after execution of the counting process mode (and after execution of the withdrawal process mode described below), when it is determined that the temporary storage section 29 lacks the partition sheets X, the control section 65 outputs a restock order signal through the display 67 and the sound generator 68 to request restock of the partition sheets X. The control section 65 also outputs a restock order signal to an external management department or a management device of a management center to request the restock of the partition sheets X via the communication section 70. Then, the display 67 and the sound generator 68 order the restock of the partition sheets, and the external management device also order restock of the partition sheets X. When it is determined that the temporary storage section 29 lacks the partition sheets X, the control section 65 automatically performs a partition sheet restock process mode to restock the partition sheets X.

After completion of the partition sheet restock process mode, only when it is determined from the detection results of the identification section 28 and the region identification sensor 62 that the partition sheets X are restocked into the temporary storage section 29 through this partition sheet restock process, the control section 65 performs the following process. That is, first, the control section 65 cause the partition sheets X to be received in at least one of the counterfeit banknote collection section 30 and the common non-taken banknote collection section 39, in which "no sheet" is stored, corresponding to "no sheet" from the first partition sheet X on a release side restocked into the temporary storage section 29. The control section 65 also overwrites the identification management number of the partition sheet X stored in the storage section 66 so as to change "no sheet" into an identification management number of the received partition sheet X. After completely removing the "no sheet" state as described above, the control section 65 permits transition to the deposit process mode and the counting process mode (and the withdrawal process mode described below) that are the normal process modes. That is, if the partition sheets X are not received in the temporary storage section 29, the control section 65 prohibits the transition to the deposit process mode and the counting process mode (and the withdrawal process mode described below) as the normal process modes so that the banknote processing machine 11 cannot perform process in the deposit process mode or the counting process mode (or the following withdrawal process mode described below).

When the process in the "partition sheet restock process mode" is performed in a state in which "no sheet" is stored in relation to in at least one of the counterfeit banknote collection section 30 and the common non-taken banknote collection section 39, the control section 65 may perform the following process instead of executing a receipt process of the partition sheet X corresponding to "no sheet," once all of the partition sheets X are restocked into the temporary storage section 29 as described above. That is, the control section 65 supplies the partition sheet X to at least one of the counterfeit banknote collection section 30 and the common non-taken banknote collection section 39 in the "no sheet" state to remove the "no sheet" state, and then, restocks the remaining partition sheets X into the temporary storage section 29. The control section 65 also overwrites the identification management number of the partition sheet X stored in the storage section 66 so as to change "no sheet" into an identification management number of the received partition sheet X received.

The current process may be changed as described below. That is, the banknotes S are received in at least one of the counterfeit banknote collection section 30 and the common non-taken banknote collection section 39, and the partition sheets X are distributed to the received banknotes S without short of the stocks thereof. Then, when the partition sheets X are gone from the temporary storage section 29, it is determined that the temporary storage section 29 lacks the partition sheets X, and a restock order signal is output to the display 67, the sound generator 68, and the external management device. As a result, even when the temporary storage section 29 lacks the partition sheets X, it is still possible to carry on transactions using the banknote processing machine 11 until when the banknotes S are received in at least one of the counterfeit banknote collection section 30 and the common non-taken banknote collection section 39 in the following process. Therefore, it is sufficient that the partition sheets X are restocked within that time, so that smooth service management can be promoted. In addition, even in the case where the restocked partition sheets X are not prepared on the side of the banknote processing machine 11 due to certain circumstances, it is possible to obtain a preparation time to avoid inconsistency. In this case, even when it is determined that the temporary storage section 29 lacks the partition sheets X, the control section 65 does not automatically perform the partition sheet restock process mode. Afterwards, when the banknotes S are received in at least one of the counterfeit banknote collection section 30 and the common non-taken banknote collection section 39 without distributing the partition sheets X, the control section 65 automatically performs the partition sheet restock process mode. Alternatively, when there is no partition sheet X in the temporary storage section 29, the partition sheet restock process mode may be automatically performed.

According to the first embodiment as described above, the temporary storage section 29 includes a pair of the banknote stack drum (i.e. the first drum) 55 and the tape rewinding drum 56 (i.e., the second drum), and the tape T wound therebetween, and releasably receives the conveyed banknote S by winding it on the banknote stack drum 55 along with the tape section TA for banknotes. The temporary storage section 29 releasably receives the partition sheet X by winding it on the banknote stack drum 55 together with the tape section TB for partition sheets positioned at a side of an end fixed to the banknote drum 55, with respect to the tape section TA for banknote sheets. In response to the counterfeit banknote collection section 30 or the common non-taken banknote collection section 39 receiving the banknotes X, the control section 65 causes the temporary storage section 29 to release the partition sheet X wound on the banknote stack drum 55, and causes the counterfeit banknote collection section 30 or the common non-taken banknote collection section 39 to receive the partition sheet X from the temporary storage section 29. For this reason, the plurality of banknotes S are received in the same counterfeit banknote collection section 30 or the same common non-taken banknote collection section 39, and the partition sheets X can be disposed at a desired place, and thus it is possible to discriminate the banknotes S using the partition sheets X to manage the denomination and number of banknotes.

That is, the banknotes S are discriminated at every counterfeit banknote partition sheet distribution operation, and thus, the banknotes S are discriminated whenever each process accompanied with the counterfeit banknote partition sheet distribution operation is performed. Therefore, the denomination and number of banknotes S identified as counterfeit banknotes are managed per counterfeit banknote partition sheet distribution operation (i.e., per customer), and thus, effective service management can be promoted well. Similarly, the banknotes S are discriminated at every non-taken banknote partition sheet distribution operation, and thus, the banknotes S are discriminated whenever each process accompanied with the non-taken banknote partition sheet distribution operation is performed. Therefore, the denomination and number of banknotes related to non-taken banknotes S are managed per non-taken banknote partition sheet distribution operation (i.e., per customer), and thus, effective service management can be promoted well.

Moreover, the identification management numbers of the partition sheets X are stored in the storage section 66 in relation to the process identification number whenever each process accompanied with the counterfeit banknote partition sheet distribution operation is performed, and the identification management numbers of the partition sheets X are stored in the storage section 66 in relation to the process identification number whenever each process accompanied with the non-taken banknote partition sheet distribution operation is performed. For this reason, after completion of the customer service, when the counterfeit banknote collection section 30 and the non-taken banknote collection section 39 are opened, transaction data of a host machine (not shown), such as for example, an automated teller machine (ATM), and the denomination and number of the abnormal banknotes composed of the banknotes S identified as counterfeit banknotes and the non-taken banknotes S, which are discriminated by the partition sheets X, are precisely investigated, so that the denomination and number of the banknotes related to the counterfeit banknotes and the non-taken banknotes per process (i.e., per customer) can be managed. For example, one or a plurality of abnormal banknotes (hereinafter, referred to as an abnormal banknote group) before the partition sheet of a management number N1 may be classified as an abnormal banknote group of a process M1, an abnormal banknote group between the partition sheet of the management number N1 and the partition sheet of a management number N2 may be classified as an abnormal banknote group of a process M2. Similarly, an abnormal banknote group between the partition sheet of a management number Nn and the partition sheet of a management number Nn+1 may be classified as an abnormal banknote group of a process Mn+1.

In addition, the temporary storage section 29 releasably receives the partition sheet X by winding it on the banknote stack drum 55 together with the tape section TB for partition sheets positioned at a side of an end fixed to the banknote stack drum 55, with respect to the tape section TA for banknote sheets, and releases the partition sheet X as needed. Therefore, there is no need for an exclusive mechanism for receiving and releasing the partition sheets X, and thus cost can be reduced.

Further, the partition sheet X can be introduced from the temporary storage section 29 to the counterfeit banknote collection section 30 which receives a banknote S received in the insertion section 20 and identified as a counterfeit banknote by the identification section 28, the common non-taken banknote collection section 39 which returns a banknote S unidentified by the identification section 28 so as to be removable from the machine, and returns a banknote S released from the temporary storage section 29 so as to be removable from the machine. For this reason, it is possible to classify and manage the banknotes S received in the counterfeit banknote collection section 30 and the common non-taken banknote collection section 39.

Furthermore, it is possible to classify and manage the banknotes S in the common non-taken banknote collection section 39 which receives the non-taken banknotes S from the common discharge section 35 through which the banknotes unidentified by the identification section 28 and the banknotes S released from the temporary storage section 29 are returned so that they can be removable from the machine.

In addition, since the tape T is configured such that the tape section TB for partition sheets for receiving the partition sheets X and the tape section TA for banknotes are made different in width to be discriminated therefrom, the identification sensor 62 can clearly discriminate them to enable precise position control.

Further, in response to the control section 65 determining that the temporary storage section 29 lacks the partition sheet X after performing a normal process mode, the control section 65 automatically transit to a partition sheet restock process mode for restocking a partition sheet, and it allows transition to the normal process mode only when a partition sheet X is restocked in the temporary storage section 29, so that it is possible to securely prevent the partition sheets X from being lacked.

Furthermore, in response to the control section 65 determining that the temporary storage section 29 lacks the partition sheet X, the control section 65 outputs a restock order signal to request restock of the partition sheet X. For this reason, for example, even when a preparatory partition sheet storage place is far from the banknote processing machine, it is possible to instruct an external management department or a management center to restock of the partition sheets, and promote smooth service management.

Although in the banknote processing machine 11 of the first embodiment, the partition sheets X are supplied from the temporary storage section 29 to two places, i.e., the counterfeit banknote collection section 30 and the common non-taken banknote collection section 39, the partition sheets X may also be supplied to only one place only.

Further, in the banknote processing machine 11 of the first embodiment, the case in which the common discharge section 35 which returns the banknotes S unidentified by the identification section 28 and the banknotes S released from the temporary storage section 29 so that they can be removable from the machine is provided, and one common non-taken banknote collection section 39 is provided with the common discharge section 35 has been exemplarily described. However, the present embodiment is not limited thereto. For example, a first return section which returns the banknotes S unidentified by the identification section 28 so that they can be removable from the machine and a second return section which returns the banknotes released from the temporary storage section 29 so that they can be removable from the machine may be separately provided, and, a first non-taken banknote collection section which receives the banknotes S remain in the first return section and a second non-taken banknote collection section which receives the banknotes S remain in the second return section may be separately installed. In this case, the partition sheets X may be supplied from the temporary storage section 29 to all of the counterfeit banknote collection section 30 and the first and second non-taken banknote collection sections; the partition sheets X may be supplied from the temporary storage section 29 to any two of the counterfeit banknote collection section 30, the first non-taken banknote collection section, and the second non-taken banknote collection section; or the partition sheets X may be supplied from the temporary storage section 29 to any one of the counterfeit banknote collection section 30, the first non-taken banknote collection section, and the second non-taken banknote collection section.

Figure 4:
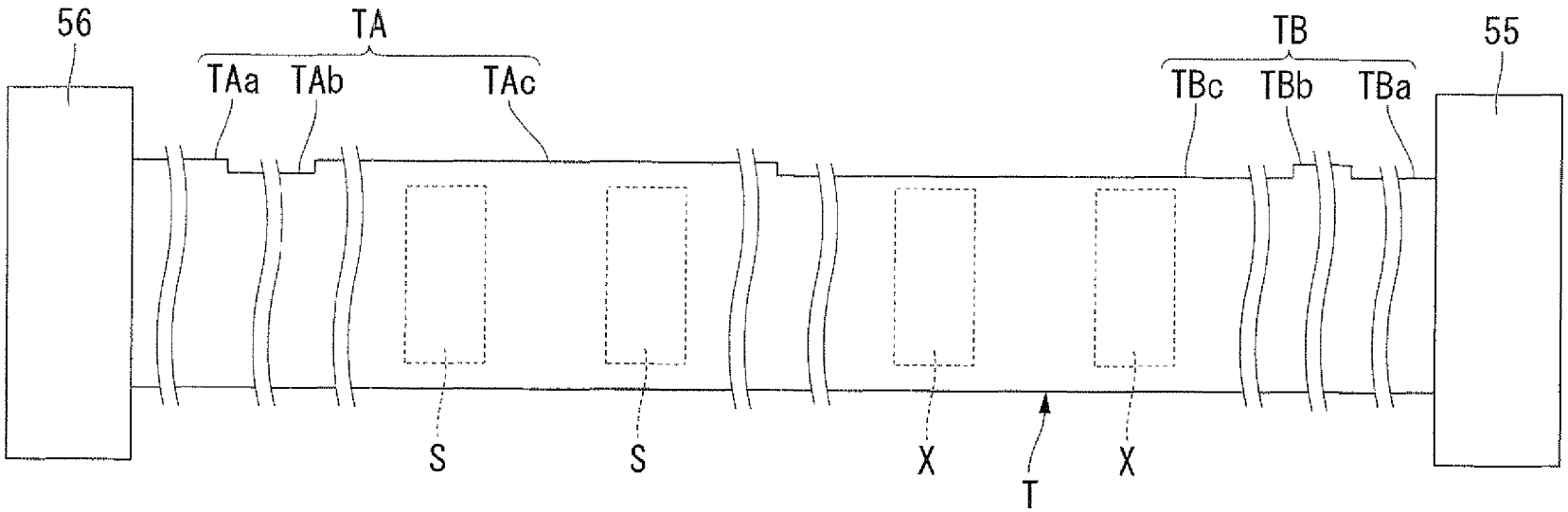
FIG. 4 is a deployment view of major portions of a modified example of the banknote processing machine in accordance with the first embodiment of the present invention.

Furthermore, in the banknote processing machine 11 of the first embodiment, while the case in which the banknotes S and the partition sheets X are aligned to be conveyed in a long-side conveyance direction has been exemplarily described, they may be aligned to be conveyed in a short-side conveyance direction. In this case, the tape T of the temporary storage section 29 may have a larger width than the above, as shown in FIG. 4. Even in this case, as shown in FIG. 4, the same kinds of adjacent regions TAa to TAc and TBa to TBc may be discriminated from each other through difference in widths or colors, transmittances of light, design, and so on.

Figure 5A:
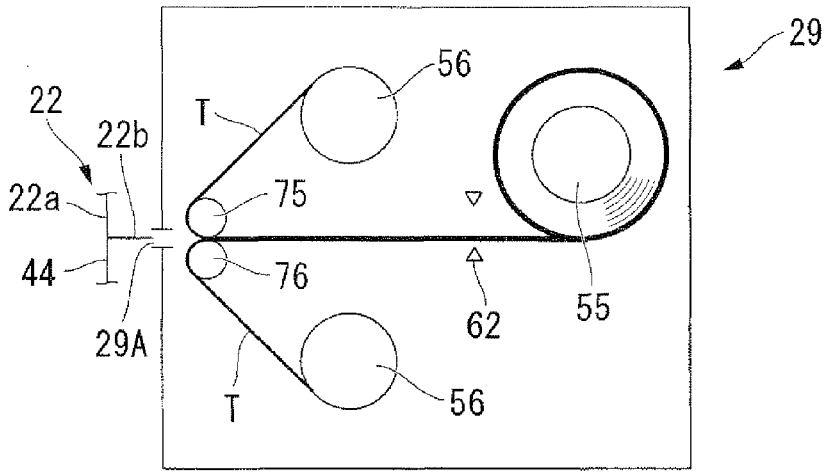
FIG. 5A is an enlarged side view of major portions of a banknote processing machine in accordance with a second embodiment of the present invention.
Figure 5B:
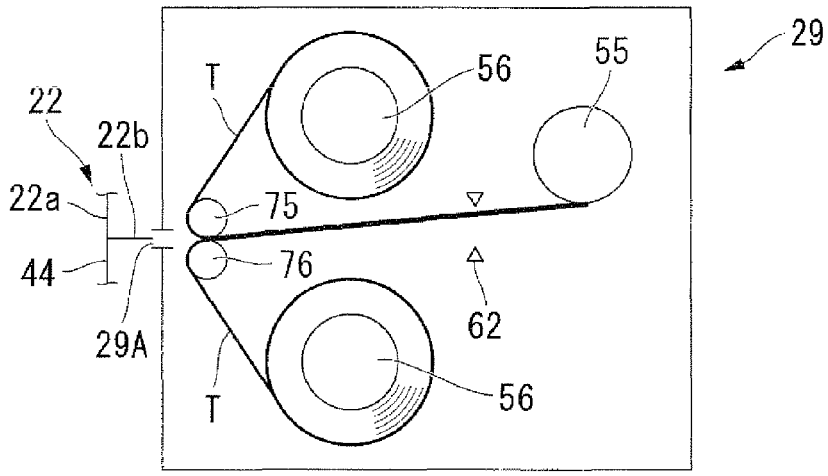
FIG. 5B is an enlarged side view of the major portions of the banknote processing machine in accordance with the second embodiment of the present invention.

Next, a banknote processing machine according to a second embodiment of the present invention will be described with reference to FIGS. 5A to 5C, focusing on parts that differ from the first embodiment.

In the second embodiment, the temporary storage section 29 has a different structure compared to that of the first embodiment. That is, in the first embodiment, one tape T is placed between one banknote stack drum 55 and one tape rewinding drum 56. In the temporary storage section 29 of the second embodiment, two tape rewinding drums 56, which are rotated in synchronization to one banknote stack drum 55, are installed so that one tape T is placed between the banknote stack drum 55 and the one tape rewinding drum 56, and another tape T is placed between the banknote stack drum 55 and the other tape rewinding drum 56.

That is, in the temporary storage section 29 of the second embodiment, the banknote stack drum 55 is installed on a side opposite to the entrance 29A, and the pair of tape rewinding drums 56 are installed on a side of the entrance 29A so that they are parallel to each other. One ends of the one tape T and the other tape T are fixed to the banknote stack drum 55 at the same position and then wound on the banknote stack drum 55 in the same direction. The other ends of the one tape T and the other tape T are fixed to the one tape rewinding drum 56 and the other tape rewinding drum 56 respectively, and then the one tape T is wound on the one of the tape rewinding drum 56 in a clockwise direction, and the other tape T is wound on the other tape rewinding drum 56 in an opposite direction, i.e., a counterclockwise direction.

The one tape T wound on the banknote stack drum 55 extends from a lower section of the banknote stack drum 55 toward the entrance 29A so as to overlap the other tape T to form substantially the same straight line as a lateral conveyance path 22*b* at a distal end of a conveyance section 22. The one tape is then bent upward by a roller 75, and is wound on the one or upper tape rewinding drum 56. At this time, the tape T is wound to extend from an upper section of the side of an entrance 29A of the tape rewinding drum 56 in a front-down direction. The other tape T extends from a lower section of the banknote stack drum 55 toward the entrance 29A so as to overlap the one tape T to form substantially the same straight line as the lateral conveyance path 22*b* at the distal end of the conveyance section 22. The other tape T is then bent downward by a roller 76 and wound on the other or lower tape rewinding drum 56. At this time, the tape T is wound to extend from a lower section of the side of the entrance 29A of the tape rewinding drum 56 in a front-up direction.

When the two tapes T are wound on the banknote stack drum 55, the one tape rewinding drum 56 and the other tape rewinding drum 56 are cooperatively rotated via the respective tapes T to release the respective tapes T. On the other hand, when the one tape T is wound on the one tape rewinding drum 56 and the other tape T is wound on the other tape rewinding drum 56, the banknote stack drum 55 is cooperatively rotated via both of the tapes T to release both of the tapes T.

Upon temporary storage of the banknotes S, the banknotes S separated and conveyed one by one by a longitudinal conveyance section 22*a* of the conveyance section 22 are sent from the lateral conveyance path 22*b* to the entrance 29A of the temporary storage section 29 at a predetermined speed by a conveyance drive force of the longitudinal conveyance section 22*a*. At this time, the banknote stack drum 55 is rotated in a predetermined banknote receipt direction (i.e. in a counterclockwise direction in FIGS. 5A to 5C), the one or upper tape rewinding drum 56 is rotated in the banknote receipt direction (i.e. in a counterclockwise direction in FIGS. 5A to 5C), and the other or lower tape rewinding drum 56 is rotated in the predetermined banknote receipt direction (i.e. in the clockwise direction in FIGS. 5A to 5C). The banknotes S delivered from the conveyance section 22 are sandwiched between both of the tapes T at center positions in short side directions thereof to be wound on both of the tapes T already wound on the banknote stack drum 55 along with both of the tapes T. The banknotes S sequentially delivered into the temporary storage section 29 are wound on the banknote stack drum 55 along with both of the tapes T to be received on the banknote stack drum 55 in a stacked state (see FIG. 5A). This is a winding operation.

On the other hand, the pair of tape rewinding drums 56 and the banknote stack drum 55 are rotated in a predetermined banknote release direction opposite to the banknote receipt direction so that the banknotes S stacked on the banknote stack drum 55 are separated and released from the banknote stack drum 55 along with both of the tapes T in a sandwiched state between the tapes T. Both of the tapes T are spaced apart at the entrance 29A of the temporary storage section 29, so that the banknotes S are separated from both of the tapes T to be released to the conveyance section 22 (see FIG. 5C). This is a rewinding operation.

As described above, the winding operation and the rewinding operation of the tapes T are performed between the pair of tape rewinding drums 56 and the banknote stack drum 55 so that stacked receipt and separated release of the banknotes S introduced one by one are performed.

In the second embodiment, both of the tapes T of the temporary storage section 29 have the same shape as the tape T of the first embodiment.

A region identification sensor 62 similar to that of the first embodiment is installed adjacent to the banknote stack drum 55. The region identification sensor 62 detects a difference between widths of overlapped portions of both tapes T extending forward from the banknote stack drum 55 to form substantially the same straight line as the lateral conveyance path 22*b* at a position of the entrance path, thereby detecting the respective regions TAa to TAc and TBa to TBc of both of the tapes T. That is, both of the tapes T at the entrance path position overlap with each other at the same region and at the same boundary position, so that the overlapped portion is detected by the region identification sensor 62.

Figure 5C:
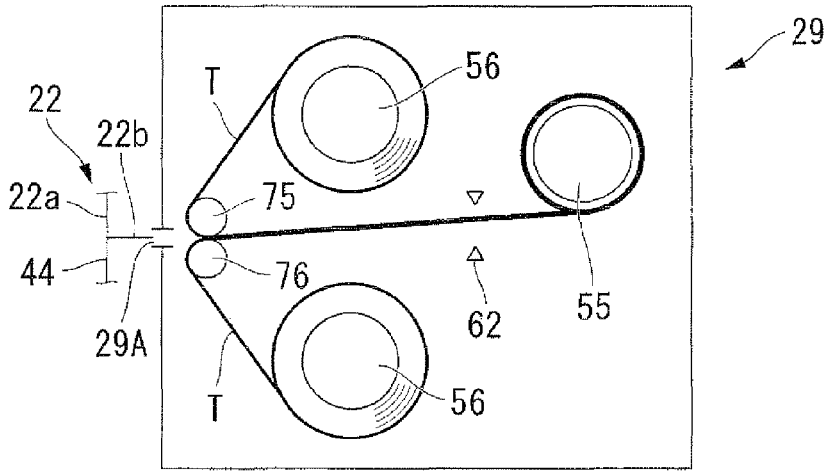
FIG. 5C is an enlarged side view of the major portions of the banknote processing machine in accordance with the second embodiment of the present invention.

In the second embodiment, in the temporary storage section 29 a state in which a boundary position between the tape section TA for banknotes and the tape section TB for partition sheets, i.e., a boundary position between the banknote receiving region TAc and the partition sheet receiving region TBc, at which both of the tapes T overlap with each other, is detected by the region identification sensor 62, is a standby state (see FIG. 5C).

In the second embodiment, upon execution of the partition sheet restock process, when there are some partition sheets X in the temporary storage section 29 although the partition sheets X in the temporary storage section 29 are not in a maximum receipt state, the control section 65 drives the temporary storage section 29 to perform the winding operation on the banknote stack drum 55, both of the tapes T, and both of the tape winding drums 56 in a standby state, and stops the banknote stack drum 55, both of the tapes T, and both of the tape winding drums 56 when a leading end of a first partition sheet X on a release side is detected by the region identification sensor 62.

When there is no partition sheet X in the temporary storage section 29, the control section 65 drives the temporary storage section 29 to perform the rewinding operation on the banknote stack drum 55, both of the tapes T, and both of the tape winding drums 56 in a standby state. When both of the tapes T are set to a rewinding end state in which a boundary position between the rewinding near-end region TBb and the rewinding end region TBa is detected by the region identification sensor 62, the control section 65 stops the banknote stack drum 55, both of the tapes T, and both of the tape winding drums 56, as shown in FIG. 5B.

The winding operation is performed on the banknote stack drum 55, both of the tapes T, and both of the tape winding drums 56 of the temporary storage section 29 on the basis of detection timing of the partition sheet X by the identification section 28, and the partition sheets X are sandwiched between the partition sheet receiving regions TBc of both of the tapes T to be sequentially wound and received on the banknote stack drum 55 at predetermined intervals. When the boundary positions between the tape section TB for partition sheets and the tape section TA for banknotes of both of the tapes T are detected by the region identification sensor 62, the control section 65 stops the banknote stack drum 55, both of the tapes T, and both of the tape winding drums 56, to cause the temporary storage section 29 to be in a standby state as shown in FIG. 5C.

In the deposit process, the control section 65 causes the banknotes S identified as genuine banknotes by the identification section 28 to be conveyed toward the temporary storage section 29. The control section 65 causes the banknotes S to be sequentially received on the rotating banknote stack drum 55 along with both of the banknote storage regions TAc at predetermined intervals by sandwiching them between the banknote storage regions TAc of both of the tapes T through the winding operation of the banknote stack drum 55, both of the tapes T, and both of the tape rewinding drums 56 which were in the standby state. The control section 65 stops the banknote stack drum 55, both of the tapes T, and both of the tape rewinding drums 56, when the banknote S finally identified as a genuine banknote by the identification section 28 is received in the temporary storage section 29 (see FIG. 5A).

In the storage process and the returning process performed at a second half of the deposit process, the control section 65 causes the temporary storage section 29 to perform the rewinding operation to sequentially release the banknotes S wound on the banknote stack drum 55 with both of the banknote storage regions TAc of both of the tapes T. During the rewinding operation, when the boundary position between the tape section TA for banknotes and the tape section TB for partition sheets of both of the tapes T overlapping with each other is detected by the region identification sensor 62, the control section 65 stops the banknote stack drum 55, both of the tapes T, and both of the tape rewinding drums 56, to set them to the standby state shown in FIG. 5C.

In the counterfeit banknote partition sheet distribution operation, the control section 65 drives the temporary storage section 29 to perform the winding operation on the banknote stack drum 55, both of the tapes T, and both of the tape rewinding drums 56 in the standby state, thereby sending one partition sheet X to the counterfeit banknote collection section 30. When the region identification sensor 62 detects that the one partition sheet X is released from the banknote stack drum 55, the control section 65 returns the banknote stack drum 55, both of the tapes T, and both of the tape rewinding drums 56, to the standby state shown in FIG. 5C.

In the non-taken banknote partition sheet distribution operation, the control section 65 drives the temporary storage section 29 to perform the rewinding operation on the banknote stack drum 55, both of the tapes T, and both of the tape rewinding drums 56 in the standby state, thereby sending one partition sheet X to the discharge port 13. When the region identification sensor 62 detects that the one partition sheet X is released from the banknote stack drum 55, the control section 65 returns the banknote stack drum 55, both of the tapes T, and both of the tape rewinding drums 56, to the standby state. In this case also, when both of the counterfeit banknote partition sheet distribution operation and the non-taken banknote partition sheet distribution operation are performed through one process, the temporary storage section 29 may not be returned to the standby state until a first partition sheet X is released and then a second partition sheet X is released.

In the second embodiment as described above, the two tape rewinding drums 56, which are rotated in a synchronized manner, are used to overlap the two tapes T to be wound and rewound on the banknote stack drum 55. At this time, the center positions of short-side directions of the banknotes S and the partition sheets X can be sandwiched between the two overlapped tapes T. For this reason, the banknotes S and the partition sheets can be stably stacked on the banknote stack drum 55 and stably released from the banknote stack drum 55.

Next, a banknote processing machine according to a third embodiment of the present invention will be described with reference to FIGS. 6A to 6C and 7, focusing on portions that differ from the first embodiment.

In the third embodiment, the temporary storage section 29 has a different constitution compared to that of the first embodiment. That is, in the first embodiment, both of the banknotes S and the partition sheets X are received on the banknote stack drum 55, which is one of the pair of the banknote stack drum 55 and the tape rewinding drum 56. In the temporary storage section 29 of the third embodiment, the banknotes S are wound and received on one of the drums, this is, the banknote stack drum 55 along with the tape T, and the partition sheets X are wound and received on the other drum, that is, the tape rewinding drum 56 along with the tape T.

Figure 6A:
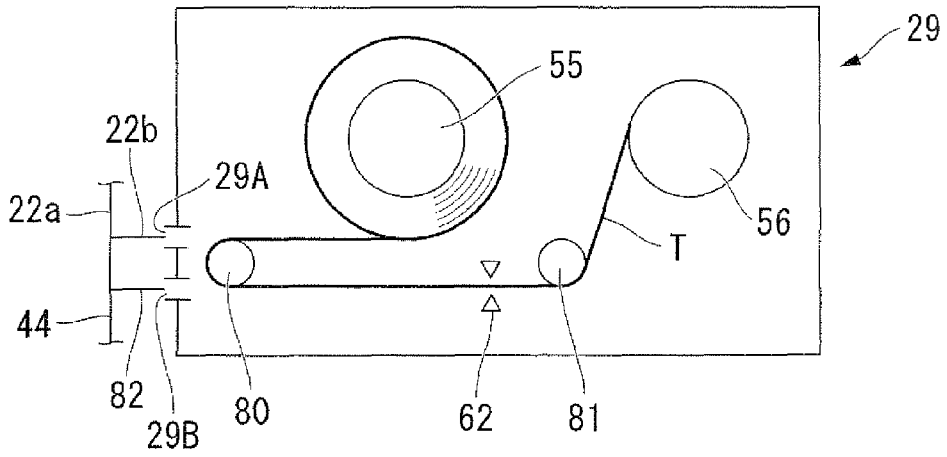
FIG. 6A is an enlarged side view of major portions of a banknote processing machine in accordance with a third embodiment of the present invention.
Figure 6B:
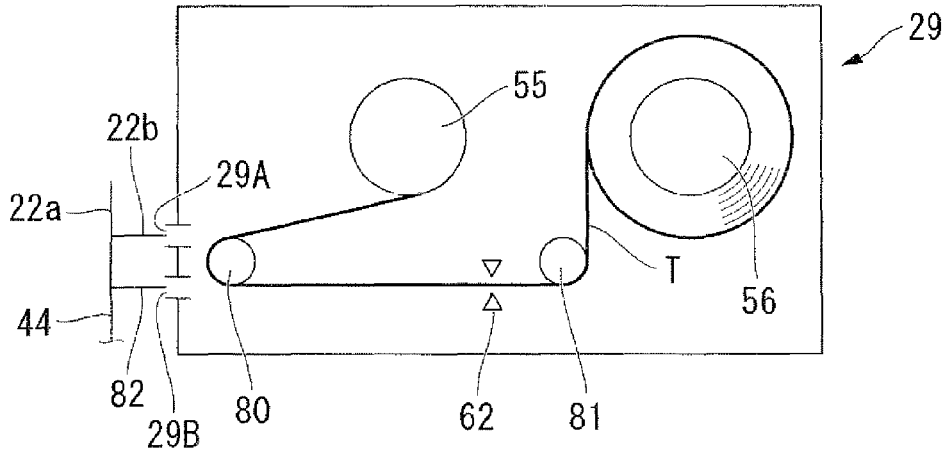
FIG. 6B is an enlarged side view of the major portions of the banknote processing machine in accordance with the third embodiment of the present invention.
Figure 6C:
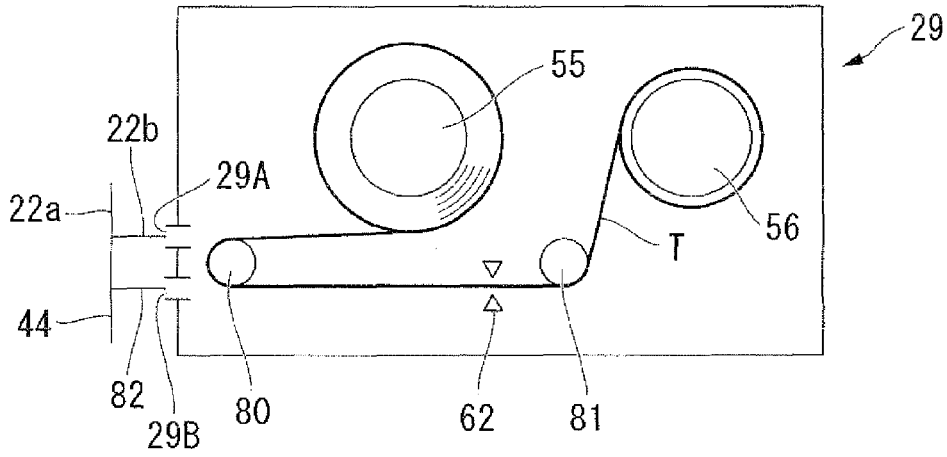
FIG. 6C is an enlarged side view of the major portions of the banknote processing machine in accordance with the third embodiment of the present invention.

As shown in FIGS. 6A to 6C, in the temporary storage section 29 of the third embodiment, similar to the first embodiment, the banknote stack drum 55 is installed on the side of the entrance 29A, and the tape rewinding drum 56 is installed on a side opposite to the entrance 29A, which are parallel to each other, so that one end of the tape T is fixed to the banknote stack drum 55 and the other end of the tape T is fixed to the tape rewinding drum 56. The tape T wound on the banknote stack drum 55 extends from a lower section of the banknote stack drum 55 toward the entrance 29A to form substantially the same straight line as the lateral conveyance path 22*b*. The tape T is then bent downward by a roller 80 to extend to the side opposite to the entrance 29A, and then, extends upwardly from a roller 81 opposite to the entrance 29A to be wound on the tape rewinding drum 56. At this time, the tape T is wound to extend downwardly from the side of the entrance 29A of the tape rewinding drum 56.

In the third embodiment, a conveyance path 82 branching off from the conveyance section 44 and horizontally extending backward therefrom is further provided. A portion between the roller 80 and the roller 81 of the tape T of the temporary storage section 29 is substantially the same straight line as the conveyance path 82, and another entrance 29B of the temporary storage section 29 is installed therebetween.

Figure 7:
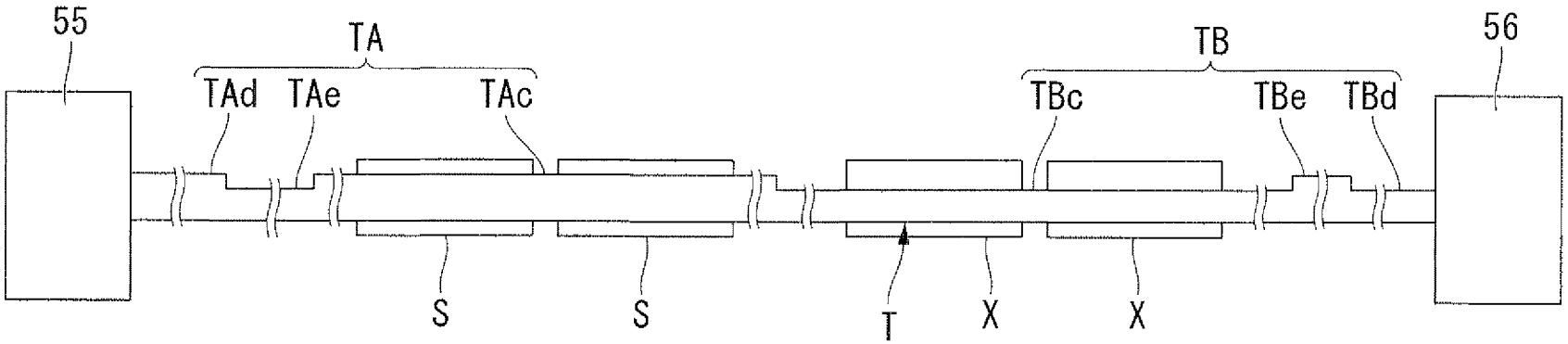
FIG. 7 is a deployment view of major portions of the banknote processing machine in accordance with the third embodiment of the present invention.

In the third embodiment, as shown in FIG. 7, the tape T has a tape section TA for banknotes, and a tape section TB for partition sheets. The tape section TA for banknotes is a predetermined portion of the tape T at a fixed end side of the banknote stack drum 55 The tape section TB for partition sheets is a predetermined portion of the tape T at a fixed end side of the tape rewinding drum 56.

The tape section TA for banknotes has a rewinding end region TAd, a rewinding near-end region TAe, and a banknote receiving region TAc. The rewinding end region TAd has a large width and is a predetermined portion of the tape section TA including the end fixed to the banknote stack drum 55. The rewinding near-end region TAe has a small width and is a predetermined portion of the tape section TA opposite to the end fixed to the banknote stack drum 55 with respect to the rewinding end region TAd. The banknote stack drum TAc has a large width and is a predetermined portion of the tape section TA opposite to the rewinding end region TAd with respect to the rewinding near-end region TAe.

The tape section TB for partition sheets has a winding end region TBd, a winding near-end region TBe, and a partition sheet storage region TBc. The winding end region TBd has a small width and is a predetermined portion of the tape section TB including an end fixed to the tape rewinding drum 56. The winding near-end region TBe has a large width and is a predetermined portion of the tape section TB opposite to the end fixed to the tape rewinding drum 56 with respect to the winding end region TBd. The partition sheet storage region TBc has a small width and is a predetermined portion of the tape section TB opposite to the winding end region TBd with respect to the winding near-end region TBe. The partition sheet storage region. TBc is adjacent to the banknote storage region TAc of the tape section TA for banknotes. Even in this case, the rewinding end region TAd, the banknote storage region TAc and the winding near-end region TBe have the same large widths. The rewinding near end region TAe, the partition sheet storage region TBc, and the winding end region TBd has the same small widths.

Upon temporary storage of the banknotes S, the banknotes S separated and conveyed one by one from the lateral conveyance path 22*b* at a distal position of the conveyance section 22 are sent from the lateral conveyance path 22*b* to the entrance 29A of an upper side of the temporary storage section 29 at a predetermined speed by a conveyance drive force of the longitudinal conveyance section 22*a*. At this time, the tape rewinding drum 56 and the banknote stack drum 55 perform a winding operation of winding the tape T on the banknote stack drum 55 and releasing the tape T from the tape rewinding drum 56. As a result, the banknotes S sent from the conveyance section 22 are overlapped with the tape T, and are wound on the tape T already wound on the banknote stack drum 55 along with the tape T, to be sandwiched between the tape T. The banknotes S sequentially sent to the temporary storage section 29 are wound on the banknote stack drum 55 along with the tape T as described above, and received on the banknote stack drum 55 in a stacked state (see FIG. 6C). At this time, the banknotes S are received in the banknote storage region TAc of the tape T.

Upon release of the banknotes S, the tape rewinding drum 56 and the banknote stack drum 55 perform a rewinding operation of winding the tape T on the tape rewinding drum 56 and releasing the tape T from the banknote stack drum 55. As a result, the banknotes S stacked on the banknote stack drum 55 are separated and released from the banknote stack drum 55 along with the overlapped portion of the tape T, and then, separated from the tape T at a position of the entrance 29A to be released to the lateral conveyance path 22*b* of the conveyance section 22 (see FIG. 6B).

Upon storage of the partition sheets X, the partition sheets X separated and conveyed via the conveyance sections 22 and 44 one by one are sent from the conveyance path 82 to an entrance 28B of a lower side of the temporary storage section 29 at a predetermined speed by a conveyance drive force of the conveyance path 44 side. At this time, the tape rewinding drum 56 and the banknote stack drum 55 perform a rewinding operation of winding the tape T on the tape rewinding drum 56 and releasing the tape T from the banknote stack drum 55, so that the partition sheets S sent from the conveyance path 82 are overlapped with the tape T, and are wound on a portion of the tape T already wound on the tape rewinding drum 56 with the tape T, to be sandwiched between the tape T. The partition sheets X are wound on the tape rewinding drum 56 with the tape T as described above, and received on the tape rewinding drum 56 in a stacked state. At this time, the partition sheets X are received on the partition sheet storage region TBc of the tape T.

Upon release of the partition sheets X, the tape rewinding drum 56 and the banknote stack drum 55 perform a winding operation of winding the tape T on the banknote stack drum 55 and releasing the tape T from the tape rewinding drum 56. As a result, the partition sheets X stacked on the tape rewinding drum 56 are separated and released from the tape rewinding drum 56 along with the overlapped portion of the tape T to be separated from the tape T at the entrance 29B and released to the conveyance path 82.

A region identification sensor 62 similar to that of the first embodiment is installed adjacent to the tape rewinding drum 56. The region identification sensor 62 detects a difference in width of the tape T at a position of a partition sheet entrance path extending forward from the tape rewinding drum 56 to form substantially the same straight line as the conveyance path 82, thereby detecting the respective regions TAc to TAe and TBc to TBe of the tape T.

In the third embodiment, in the temporary storage section 29, a state in which a boundary position between the rewinding end region Tad having the large width and the rewinding near-end region Tae having the small width is detected by the region identification sensor 62, i.e., a state in which the tape section TB for partition sheets and most of the tape section TA for banknotes are wound on the tape rewinding drum 56, is a standby state shown in FIG. 6B.

In the third embodiment, upon execution of the partition sheet restock process, the control section 65 performs the following process when the partition sheets X in the temporary storage section 29 are not in a maximum receipt state but in a residual state. That is, the control section 65 drives the temporary storage section 29 to perform a winding operation on the banknote stack drum 55, the tape T, and the tape rewinding drum 56 which are in the standby state, and stops the banknote stack drum 55, the tape T and the tape rewinding drum 56 when a leading end of a first partition sheet X on a release side is detected by the region identification sensor 62.

The control section 65 performs the following process when there is no remaining partition sheet X. That is, the control section 65 drives the temporary storage section 29 to perform a winding operation on the banknote stack drum 55, the tape T, and the tape rewinding drum 56 which are in the standby state. When temporary storage section 29 is set to a winding end state in which the boundary position between the winding near-end region TBe having the large width and the winding end region TBd having the small width is detected by the region identification sensor 62, as shown in FIG. 6A, the control section 65 stops the banknote stack drum 55, the tape T, and the tape rewinding drum 56.

Then, the control section 65 causes the temporary storage section 29 to perform the rewinding operation on the banknote stack drum 55, the tape T and the tape rewinding drum 56 on the basis of detection timing of the partition sheet X by the identification section 28 so that the partition sheets X from the entrance 29B are sequentially wound and received on the rotating tape rewinding drum 56 with the partition sheet receiving region TBc of the tape T. When a predetermined number of partition sheets X are received, replenishment of the partition sheets X is completed. Afterwards, when the boundary position between the rewinding near-end region TAe having the small width and the rewinding end region TAd having the large width is detected by the region identification sensor 62, as shown in FIG. 6B, the banknote stack drum 55, the tape T, and the tape rewinding drum 56 are stopped, and thus, the temporary storage section 29 is set to the standby state.

In the deposit process, the control section 65 conveys the banknotes S identified as genuine banknotes by the identification section 28 toward the temporary storage section 29. The control section 65 sequentially winds and receives the banknotes S from the entrance 29A to the rotating banknote stack drum 55 at predetermined intervals along with the banknote receiving region TAc of the tape T through the winding operation from the standby state of the banknote stack drum 55, the tape T and the tape rewinding drum 56. The control section 65 stops the banknote stack drum 55, the tape T, and the tape rewinding drum 56 when the banknote S finally identified as a genuine banknote by the identification section 28 is wound on the temporary storage section 29 (see FIG. 6C).

The size of the insertion section 12 is configured such that the banknotes S can be inserted within the possible number of banknotes S wound on the banknote stack drum 55 by the tape section TA for banknotes of the tape T. However, in the deposit process, if the boundary position between the tape section TA for banknotes and the tape section TB for partition sheets of the tape T, i.e., the boundary position between the banknote receiving region TAc having the large width and the partition sheet receiving region TBc having the small width is detected by the region identification sensor 62, in order to prevent release of the partition sheets X, the control section 65 forcedly stops the banknote stack drum 55, the tape T, and the tape rewinding drum 56.

In the storage process and the return process after the deposit process, the control section 65 drives the temporary storage section 29 to perform the rewinding operation to sequentially release the banknotes S wound on the banknote stack drum 55 with the banknote receiving region TAc of the tape T from the entrance 29A. During the rewinding operation, when the boundary position between the rewinding near-end region TAe having the small width and the rewinding end region TAd having the large width is detected by the region identification sensor 62, as shown in FIG. 6B, the control section 65 stops the banknote stack drum 55, the tape T, and the tape rewinding drum 56.

In the counterfeit banknote partition sheet distribution operation, the control section 65 drives the temporary storage section 29 to perform the winding operation on the banknote stack drum 55, the tape T and the tape rewinding drum 56, thereby releasing one partition sheet X from the tape rewinding drum 56 to the counterfeit banknote collection section 30 via the entrance 29B. When the region identification sensor 62 detects that one partition sheet X was released from the tape rewinding drum 56, the control section 65 performs the rewinding operation on the banknote stack drum 55, the tape T and the tape rewinding drum 56 to return to the standby state.

In the non-taken banknote partition sheet distribution operation, the control section 65 drives the temporary storage section 29 to perform the winding operation on the banknote stack drum 55, the tape T and the tape rewinding drum 56, thereby releasing one partition sheet X from the tape rewinding drum 56 to the discharge port 13 via the entrance 29B. When the region identification sensor 62 detects that one partition sheet X was released from the tape rewinding drum 56, the control section 65 performs the rewinding operation on the banknote stack drum 55, the tape T, and the tape rewinding drum 56 to return to the standby state. When both of the counterfeit banknote partition sheet distribution operation and the non-taken banknote partition sheet distribution operation are performed through one process, the temporary storage section 29 is controlled not to be returned to the standby state until after a first partition sheet X is released and then a second partition sheet X is released.

According to the third embodiment as described above, the temporary storage section 29 includes the pair of the banknote stack drum 55 and the tape rewinding drum 56 and the tape T wound therebetween to wind and releasably receive the conveyed banknotes S on the banknote stack drum 55 along with the tape T. When the temporary storage section 29 winds and receives the partition sheets X on the tape rewinding drum 56 along with the tape T, and when the banknotes S are received in the counterfeit banknote collection section 30 or the common non-taken banknote collection section 39, the partition sheet X received on the tape rewinding drum 56 is released to the temporary storage section 29 to be received in the counterfeit banknote collection section 30 or the common non-taken banknote collection section 39. For this reason, when a plurality of banknotes S are received in the same counterfeit banknote collection section 30 or the same common non-taken banknote collection section 39, it is possible to dispose the partition sheet X at a desired position and thereby it is possible to discriminate banknotes using the partition sheets X and manage the denomination and number of banknotes.

In addition, since the partition sheets X are wound and received on the tape rewinding drum 56 for rewinding the tape T of the temporary storage section 29 along with the tape T and released as needed, there is no necessity for an exclusive mechanism for receiving and releasing the partition sheets X, and thus, cost can be reduced.

Figure 8A:
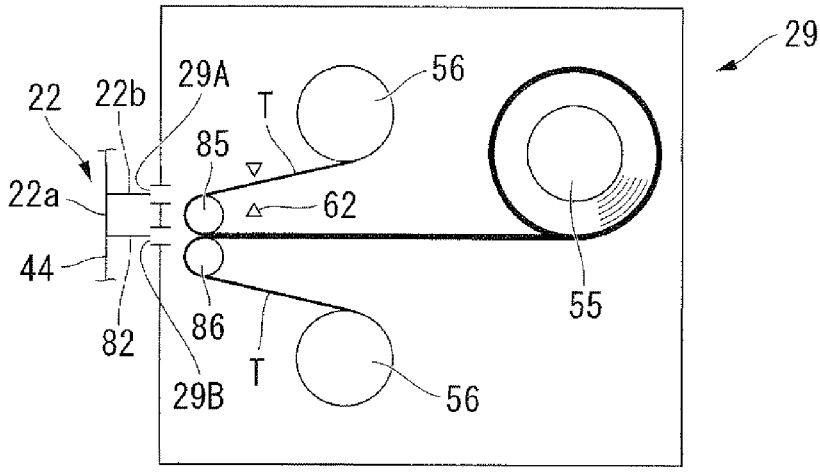
FIG. 8A is an enlarged side view of major portions of a banknote processing machine in accordance with a fourth embodiment of the present invention.

Next, a banknote processing machine according to a fourth embodiment of the present invention will be described with reference to FIGS. 8A to 8C, focusing on parts that differ from the third embodiment.

In the fourth embodiment, a temporary storage section 29 has a different constitution compared to that of the third embodiment. That is, in the third embodiment, one tape T is wound between one banknote stack drum 55 and one tape rewinding drum 56. Meanwhile, in the temporary storage section 29 of the fourth embodiment, two tape rewinding drums 56 rotated in synchronization to one banknote stack drum 55 are installed, one tape T is placed between the banknote stack drum 55 and one of the tape rewinding drums 56, and another tape T is placed between the banknote stack drum 55 and the other tape rewinding drum 56.

That is, in the temporary storage section 29 of the fourth embodiment, the banknote stack drum 55 is installed on the side opposite to the entrance 29A, and the pair of tape rewinding drums 56 are installed on a side of the entrance 29A so that they are parallel to each other. One ends of the one tape T and the other tape T are fixed to the banknote stack drum 55 at the same position, and then wound in the same direction. The other end of the one tape T is fixed to the one or upper tape rewinding drum 56, and the other end of the other tape T is fixed to the other or lower tape rewinding drum 56, which are wound in opposite directions. The tape T placed between the banknote stack drum 55 and the one upper tape rewinding drum 56 has the respective regions TAc to TAe and TBe to TBe having the same shape as in the third embodiment and different widths from each other (see FIG. 7). Meanwhile, the tape T placed between the banknote stack drum 55 and the other lower tape rewinding drum 56 has a constant width.

The one tape T wound on the banknote stack drum 55 extends forward from a lower section of the banknote stack drum 55 to overlap the other tape T to form substantially the same straight line as the conveyance path 82. The one tape T is then bent upward by a roller 85, and is wound on the one or upper tape rewinding drum 56. At this time, the one tape T extends forward from a lower section of the upper tape rewinding drum 56 to form substantially the same straight line as the lateral conveyance path 22*b*. The other tape T extends forward from the lower section of the banknote stack drum 55 to overlap the one tape T and form substantially the same straight line as the conveyance path 82. The other tape T is bent downward by a roller 86, and is wound on the other or lower tape rewinding drum 56. At this time, the other tape T is wound so as to extend from an upper section of the other or lower tape rewinding drum 56.

When the two tapes T are wound on the banknote stack drum 55, the one tape rewinding drum 56 and the other tape rewinding drum 56 are cooperatively rotated via the respective tapes T to release the respective tapes T. On the other hand, when the one tape T is wound on the one tape rewinding drum 56 and the other tape T is wound on the other tape rewinding drum 56, the banknote stack drum 55 is cooperatively rotated via both of the tapes T to release both of the tapes T.

Upon temporary storage of the banknotes S, the banknotes S separated and conveyed from the conveyance path 82 one by one are sent to the entrance 29B on a lower side of the temporary storage section 29 at a predetermined speed by a conveyance drive force of the conveyance section 44. At this time, the banknote stack drum 55 is rotated in a predetermined banknote storage direction (i.e., in a counterclockwise direction in FIGS. 8A to 8C), the one or upper tape rewinding drum 56 is rotated in a predetermined banknote storage direction (i.e., in a clockwise direction in FIGS. 8A to 9C), and the other or lower tape rewinding drum 56 is rotated in a predetermined banknote storage direction (i.e., in a counterclockwise direction in FIGS. 8A to 8C). The banknotes S delivered from the conveyance path 82 are sandwiched between both of the tapes T at center positions in short-side directions thereof to be wound on portions of both of the tapes T already wound on the banknote stack drum 55. The banknotes S sequentially delivered to the temporary storage section 29 are wound on the banknote stack drum 55 with both of the tapes T as described above, and received on the banknote stack drum 55 in a stacked state (see FIG. 8C). This is a winding operation.

Figure 8B:
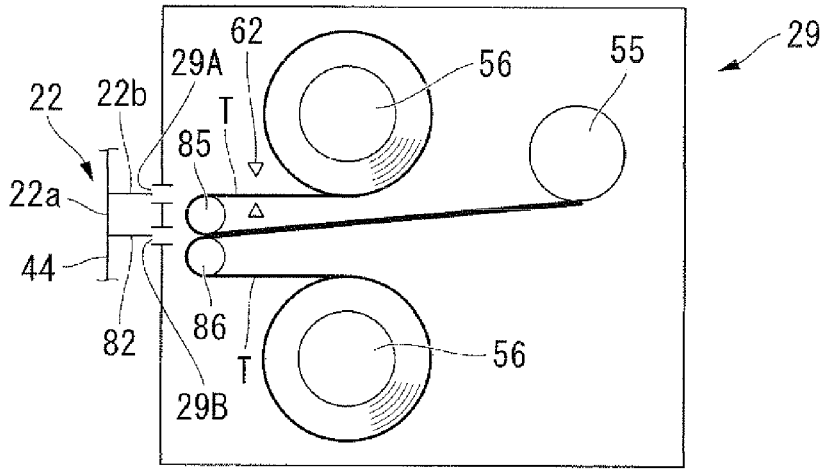
FIG. 8B is an enlarged side view of the major portions of the banknote processing machine in accordance with the fourth embodiment of the present invention.
Figure 8C:
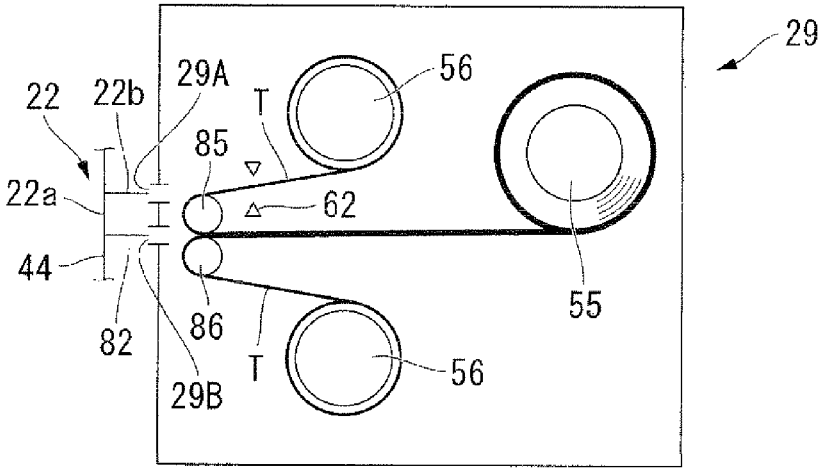
FIG. 8C is an enlarged side view of the major portions of the banknote processing machine in accordance with the fourth embodiment of the present invention.

On the other hand, when the pair of tape rewinding drums 56 and the banknote stack drum 55 are rotated in a predetermined banknote release direction opposite to the above banknote storage direction, the banknotes S stacked on the banknote stack drum 55 are separated and released from the banknote stack drum 55 with both of the tapes T in a state of being sandwiched between the tapes T and then separated from both of the tapes T at the entrance 29B of the temporary storage section 29 to be released to the conveyance path 82 (see FIG. 8B). This is a rewinding operation.

As described above, the winding operation and the rewinding operation of both of the tapes T are performed between the pair of tape rewinding drums 56 and the banknote stack drum 55 to perform stacked receipt and separated release of the banknotes S introduced one by one.

The partition sheets X are received on the one or upper tape rewinding drum 56. That is, upon storage of the partition sheets X, the partition sheets X separated and conveyed via the conveyance section 22 one by one are conveyed from the lateral conveyance path 22*b* into the entrance 29A on an upper side of the temporary storage section 29 at a predetermined speed by a conveyance drive force of the longitudinal conveyance section 22*a*. At this time, the pair of tape rewinding drums 56 and the banknote stack drum 55 perform the rewinding operation to overlap the partition sheets X sent from the conveyance section 22 with the tape T on the side of the upper tape rewinding drum 56 so that the partition sheets X are wound on a portion of the tape T already wound on the upper tape rewinding drum 56 along with the tape T and sandwiched between the tape T. The partition sheets X sequentially conveyed into the temporary storage section 29 are wound on the upper tape rewinding drum 56 along with the tape T as described above to be received on the upper tape rewinding drum 56 in a stacked state. At this time, the partition sheets X are received in the partition sheet receiving region TBc of the tape T.

Upon release of the partition sheets X, the pair of tape rewinding drums 56 and the banknote stack drum 55 perform the winding operation to separate and release the partition sheets X stacked on the upper tape rewinding drum 56 from the tape rewinding drum 56 along with the tape T, so that the partition sheets X are separated from the tape T at the entrance 29A to be released to the lateral conveyance path 22*b* of the conveyance section 22.

A region identification sensor 62 is installed adjacent to the upper tape rewinding drum 56. The region identification sensor 62 detects a difference in width of the tape T at a position of a partition sheet entrance path of the tape T extending forward from the upper tape rewinding drum 56 to form substantially the same straight line as the lateral conveyance path 22*b*, detecting the respective regions TAc to TAe and TBc to TBe of the tape T.

In the fourth embodiment, in the temporary storage section 29, a state in which the boundary position between the rewinding near-end region TAe having small width and the rewinding end region Tad having the large width wound on the upper tape rewinding drum 56 is detected by the region identification sensor 62, that is, the state in which the tape section TB for partition sheets and most of the tape section TA for banknotes of the tape T are wound on the upper tape rewinding drum 56 (the state in which the same length range of the tape T is also wound on the lower tape rewinding drum 56), is the standby state shown in FIG. 8B.

In the fourth embodiment, upon execution of the partition sheet restock process, when the partition sheets X in the temporary storage section 29 are not in a maximum received state but in a residual state, the control section 65 drives the temporary storage section 29 to perform the winding operation on the banknote stack drum 55, on both of the tapes T and on both of the tape rewinding drums 56 which have been in the standby state. The control section 65 stops the banknote stack drum 55, both of the tapes T, and both of the tape rewinding drums 56 when the region identification sensor 62 detects a leading end of the first partition sheet X at a release side received in the upper tape rewinding drum 56.

When there is no remaining partition sheet X in the temporary storage section 29, the control section 65 drives the temporary storage section 29 to perform the winding operation on the banknote stack drum 55, on both of the tapes T and on both of the tape rewinding drums 56 which have been in the standby state. When the tape T wound on the upper tape rewinding drum 56 is in a winding end state in which the boundary position between the winding near-end region TBe having the large width and the winding end region TBd having the small width is detected by the region identification sensor 62, the control section 65 stops the banknote stack drum 55, both of the tapes T, and both of the tape rewinding drums 56, as shown in FIG. 8A.

The rewinding operation is performed on the banknote stack drum 55, both of the tapes T, and both of the tape rewinding drums 56 of the temporary storage section 29 on the basis of detection timing of the partition sheet X by the identification section 28, so that the partition sheets X introduced from the lateral conveyance path 22*b* via the entrance 29A are sequentially wound and received on the rotating upper tape rewinding drum 56 at predetermined intervals along with the partition sheet storage region TBc of the tape T. After a predetermined number of partition sheets X are received, when the boundary position between the rewinding near-end region TAe having the small width and the rewinding end region TAd having the large width of is detected by the region identification sensor 62, the control section 65 stops the banknote stack drum 55, both of the tapes T, and both of the tape rewinding drums 56 to return the temporary storage section 29 to the standby state shown in FIG. 8B.

In the deposit process, the control section 65 conveys the banknotes S identified as genuine banknotes by the identification section 28 toward the temporary storage section 29. The control section 65 sequentially winds and receives the banknotes S on the rotating banknote stack drum 55 at predetermined intervals in a state of being sandwiched between both of the tapes T through the winding operation of the banknote stack drum 55, both of the tapes T and both of the tape rewinding drums 56 which have been in the standby state (see FIG. 8C). The control section 65 stops the banknote stack drum 55, both of the tapes T, and both of the tape rewinding drums 56 when the banknote S finally identified as a genuine banknote by the identification section 28 is received in the temporary storage section 29.

Even in this case, the size of the insertion section 12 is configured such that the banknotes S can be inserted within the possible number of banknotes S wound on the banknote stack drum 55 by the tape section TA for banknotes of the tape T. However, in the deposit process, when the boundary position between the tape section TA for banknotes and the tape section TB for partition sheets of the tape T, i.e., the boundary position between the banknote receiving region TAc having the large width and the partition sheet receiving region TBc having the small width is detected by the region identification sensor 62, in order to prevent release of the partition sheets X, the control section 65 forcedly stops the banknote stack drum 55, the tape T and the tape rewinding drum 56.

In the storage process and the return process after the deposit process, the control section 65 drives the temporary storage section 29 to perform the rewinding operation to sequentially release the banknotes S wound on the banknote stack drum 55 along with the tapes T from the entrance 29A. During the rewinding operation, when the boundary position between the small width of the rewinding near-end region TAe and the large width of the rewinding end region TAd is detected by the region identification sensor 62, as shown in FIG. 8B, the control section 65 forcedly stops the banknote stack drum 55, both of the tapes T, and both of the rewinding drums 56.

In the counterfeit banknote partition sheet distribution operation, the control section 65 drives the temporary storage section 29 to perform the winding operation on the banknote stack drum 55, both of the tapes T, and both of the tape rewinding drums 56, which have been in the standby state, to release one partition sheet X from the tape rewinding drum 56 to the counterfeit banknote collection section 30 via the entrance 29A. When the region identification sensor 62 detects that one partition sheet X was released from the upper tape rewinding drum 56, the control section 65 returns the banknote stack drum 55, both of the tapes T, and both of the tape rewinding drums 56 to the standby state.

In the non-taken banknote partition sheet distribution operation, the control section 65 drives the temporary storage section 29 to perform the winding operation on the banknote stack drum 55, on both of the tapes T, and on both of the tape rewinding drums 56, which have been in the standby state, thereby releasing one partition sheet X from the upper tape rewinding drum 56 to the discharge port 13 via the entrance 29A. When the region identification sensor 62 detects that one partition sheet X was released from the upper tape rewinding drum 56, the control section 65 returns the banknote stack drum 55, the tapes T and the tape rewinding drums 56 to the standby state. When both of the counterfeit banknote partition sheet distribution operation and the non-taken banknote partition sheet distribution operation are performed through one process, the temporary storage section 29 is controlled not to be returned to the standby state until a first partition sheet X is released and then a second partition sheet X is released.

According to the fourth embodiment as described above, the two tapes T are wound and rewound on the banknote stack drum 55 using the two tape rewinding drums 56 rotated in a synchronized manner, and at this time, center positions in short side directions of the banknotes S can be sandwiched between the two overlapping tapes T. For this reason, the banknotes S can be stably stacked on the banknote stack drum 55 and stably released from the banknote stack drum 55.

In the fourth embodiment, while the partition sheets X are wound and received on the upper tape rewinding drum 56 along with the tape T, the partition sheets X may also be wound and received on the lower tape rewinding drum 56 along with the tape T.

Figure 9:
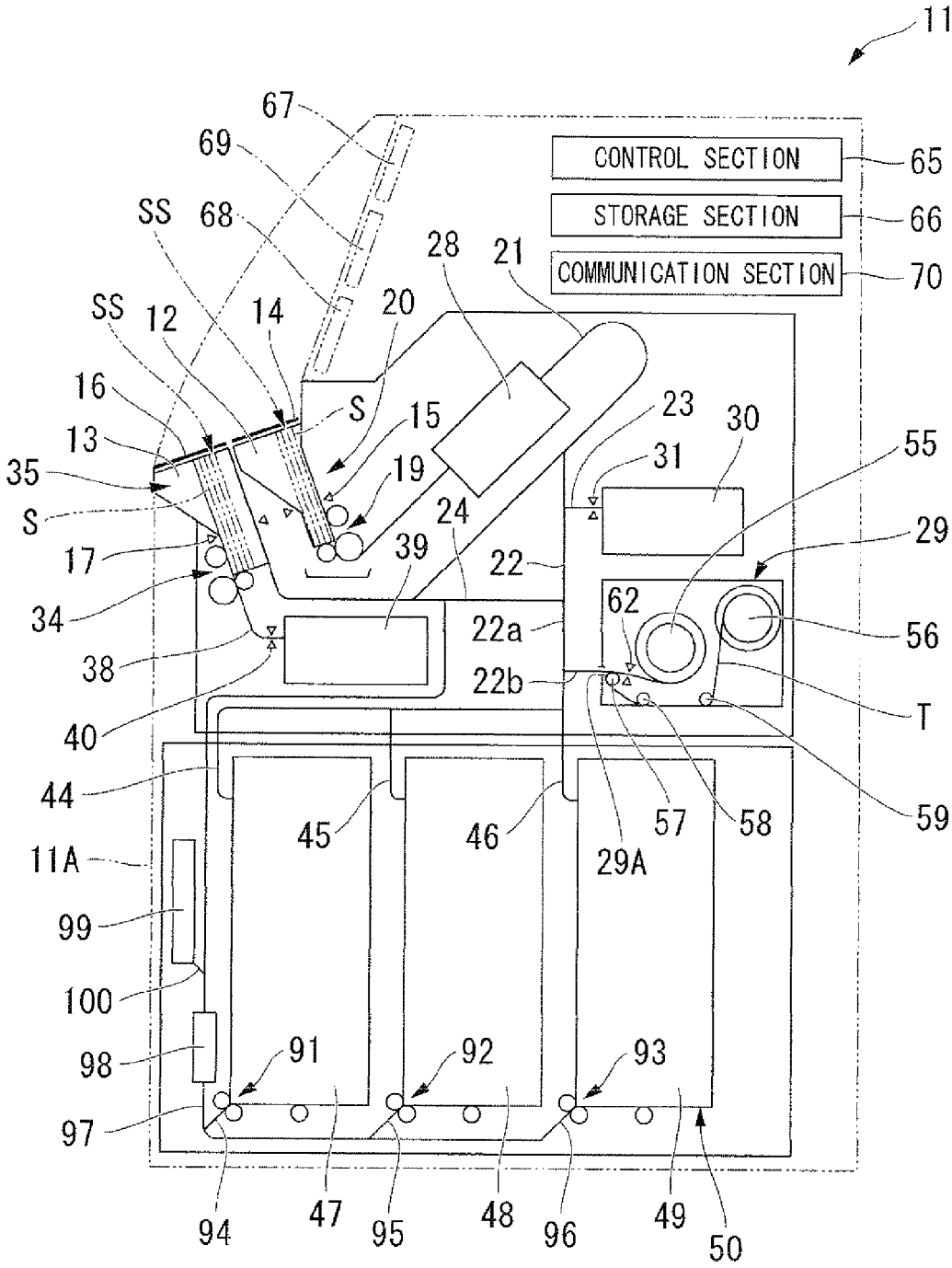
FIG. 9 is a side cross-sectional view schematically showing a banknote processing machine in accordance with a fifth embodiment of the present invention.

Next, a banknote processing machine according to a fifth embodiment of the present invention will be described with reference to FIG. 9, focusing on parts that differ from the first embodiment.

A banknote processing machine 11 according to the fifth embodiment is a deposit and withdrawal processing machine capable of performing a deposit process, a counting process, and a withdrawal process of banknotes. That is, in the fifth embodiment, withdrawal release sections 91 to 93 and conveyance sections 94 to 96 are installed at lower sections of the storage boxes 47 to 49 of the receipt section 50 of the first embodiment, respectively. The withdrawal release sections 91 to 93 separate and count the banknotes one by one, and release the banknotes. The conveyance sections 94 to 96 convey the banknotes S released from these withdrawal release sections 91 to 93. These conveyance sections 94 to 96 are joined to constitute a conveyance section 97, and the conveyance section 97 is joined with the conveyance section 24. In a midway of the conveyance section 97, a withdrawal identification section 98 is installed to detect abnormal conveyances such as overlapped conveyance, offset conveyance, or the like, of the banknotes S. A withdrawal collection section 99 for receiving the banknotes S identified as abnormal conveyances by the withdrawal identification section 98 is connected to a distal end of a conveyance section 100 branching off from the conveyance section 97.

Accordingly, after the banknotes S released from the respective storage boxes 47 to 49 of the receive section 50 are identified by the withdrawal identification section 98, only the abnormally conveyed banknotes S are received in the withdrawal collection section 99, and only the normally conveyed banknotes are released from the conveyance section 100 to a common discharge section (i.e., a first return section, a second return section, a withdrawal section, and a common delivery section) 35 to withdraw the banknotes S to be taken out of the machine. Then, the non-taken banknotes in the common discharge section 35 are collected from the separation release section 34 to the common non-taken banknote collection section (i.e., a receipt section, a first non-taken banknote collection section, a second non-taken banknote collection section, and a third non-taken banknote collection section) 39 via the conveyance section 38, as with the first embodiment.

In the fifth embodiment as described above, the partition sheet restock process mode, the deposit process mode and the counting process mode are the same as in the first embodiment, and the following withdrawal process mode, which is impossible in the first embodiment, can be performed.

[Withdrawal Process Mode (Normal Process Mode)]

When a withdrawal process mode of a normal process mode for withdrawing a predetermined denomination and number of banknotes, is selectively input to the operation section 69 to input data about the denomination and numbers of banknotes to the operation section 69, the control section 65 performs a withdrawal process. That is, the control section 65 normally drives the conveyance sections 94 to 97 to drive the withdrawal release sections 91 to 93 to an extent corresponding to the required number of banknotes depending on the data about the denominations and numbers of banknotes. Then, appropriate denominations and numbers of banknotes in the storage boxes 47 to 49 are conveyed to the conveyance sections 94 to 97 and identified by the withdrawal identification section 98. The banknotes S identified as being abnormally conveyed by the withdrawal identification section 98 are conveyed to the withdrawal collection section 99 via the conveyance sections 97 and 100, and the banknotes identified as being normally conveyed are conveyed to the discharge port 13 via the conveyance sections 97 and 24.

When the banknotes S corresponding to the data about the denominations and numbers of banknotes are discharged to the discharge port 13, the control section 65 stops the conveyance sections 94 to 97. Thereafter, the control section 65 opens the discharge port shutter 16 to open the discharge port 13, and performs display and sound output through the display 67 and the sound generator 68 to request acquisition of the banknotes S. When it is determined that there are non-taken banknotes on the basis of the above-mentioned non-taken banknote determination, the control section 65 performs the non-taken banknote partition sheet distribution operation and this withdrawal process mode is completed. That is, when it is determined that there are non-taken banknotes in the discharge port 13 by the non-taken banknote determination, the control section 65 closes the discharge port shutter 16, and then, receives the banknotes S remain in the discharge port 13 as the non-taken banknotes S in the common non-taken banknote collection section 39 by the separation release section 34 and the conveyance section 38. After that, the control section 65 drives the temporary storage section 29 to perform the rewinding operation to discharge one partition sheet X into the discharge port 13, and receives the partition sheet X in the discharge port 13 in the common non-taken banknote collection section 39, completing the withdrawal process mode.

According to the fifth embodiment as described above, the partition sheets X can be introduced from the temporary storage section 29 to the counterfeit banknote collection section 30 which receives the banknotes S received in the insertion section 20 and identified as counterfeit banknotes by the identification section 28, and the common non-taken banknote collection section 39 which receives the non-taken banknotes in the common discharge section 35. The common discharge section 35 returns the unidentified banknotes S by the identification section 28 so as to be removable from the machine, and discharges the banknotes released from the temporary storage section 29 and the banknotes S released from the receive section 50 so as to be removable from the body. For this reason, it is possible to classify and manage the banknotes S received in the counterfeit banknote collection section 30 and the common non-taken banknote collection section 39.

In addition, it is possible to classify and manage the banknotes S in the common non-taken banknote collection section 39 which receives the non-taken banknotes S from the common discharge section 35. The common discharge section 35 discharges the banknotes unidentified by the identification section 28, the banknotes S released from the temporary storage section 29, and the banknotes S released from the receive section 50 so as to be removable from the machine.

In the banknote processing machine 11 of the fifth embodiment, while the case in which the common discharge section 35 for discharging the banknotes unidentified by the identification section 28, the banknotes S released from the temporary storage section 29, and the banknotes S released from the receive section 50 to be taken out of the body is provided and one common non-taken banknote collection section 39 is provided in the common discharge section 35 has be exemplarily described, the present invention is not limited thereto. For example, a first return section for returning the banknotes S unidentified by the identification section 28 to be taken out of the body, a second return section for returning the banknotes S released from the temporary storage section 29 to be taken out of the body, and a withdrawal section for withdrawing the banknotes S released from the receive section 50 to be taken out of the body may be separately installed, and a first non-taken banknote collection section for receiving the banknotes S not taken by the first return section, a second non-taken banknote collection section for receiving the banknotes S not taken by the second return section, and a third non-taken banknote collection section for receiving the banknotes S not taken by the withdrawal section, may be separately installed. In this case, the partition sheets X may be supplied from the temporary storage section 29 to all of the counterfeit banknote collection section 30, the first non-taken banknote collection section, the second non-taken banknote collection section, and the third non-taken banknote collection section; the partition sheets X may be supplied from the temporary storage section 29 to any three of the counterfeit banknote collection section 30, the first non-taken banknote collection section, the second non-taken banknote collection section, and the third non-taken banknote collection section; the partition sheets X may be supplied from the temporary storage section 29 to any two of the counterfeit banknote collection section 30, the first non-taken banknote collection section, the second non-taken banknote collection section, and the third non-taken banknote collection section; or the partition sheets X may be supplied from the temporary storage section 29 to any one of the counterfeit banknote collection section 30, the first non-taken banknote collection section, the second non-taken banknote collection section, and the third non-taken banknote collection section.

In addition, one common non-taken banknote collection section may be installed in the first return section, in the second return section and in the withdrawal section; or one common non-taken banknote collection section may be any two of the first return section, the second return section, and the withdrawal section. Moreover, any two of the first return section, the second return section, and the withdrawal section may be one common discharge section, and even in this case, the non-taken banknote collection section may be provided to each one or provided in common.

Further, in the banknote processing machine of the fifth embodiment, while an example in which the temporary storage section 29 of the first embodiment is employed as the temporary storage section 29 has been described, any temporary storage section 29 of first to fourth embodiments may be employed.

While preferred embodiments of the invention have been described and illustrated above, it should be understood that these are exemplary of the invention and are not to be considered as limiting. Additions, omissions, substitutions, and other modifications can be made without departing from the scope of the present invention. The invention is not to be considered as being limited by the foregoing description, and is only limited by the scope of the appended claims.

What is claimed is:

1. A banknote processing machine comprising:

a receipt section adapted to receive a banknote;

a temporary storage section which includes a pair of first and second drums, and a tape wound between the pair of first and second drums, the tape having an end fixed to the first drum, a tape section for banknote sheets and a tape section for partition sheets positioned at a side of the end with respect to the tape section for banknote sheets, the temporary storage section adapted to releasably receive a conveyed banknote by winding the conveyed banknote on the first drum together with the tape section for banknote sheets and to releasably receive at least one partition sheet by winding the partition sheet on the first drum together with the tape section for partition sheets;

a control section adapted to cause the temporary storage section to release the partition sheet wound on the first drum, and to cause the receipt section to receive the partition sheet from the temporary storage section, in response to the receipt section receiving a banknote;

an insertion section adapted to receive a banknote from outside of the machine;

an identification section adapted to identify a banknote received in the insertion section;

a counterfeit banknote collection section adapted to receive a banknote identified as a counterfeit banknote by the identification section;

a first return section adapted to return a banknote unidentified by the identification section so as to be removable from the machine;

a second return section adapted to return a banknote released from the temporary storage section so as to be removable from the machine;

a receive section adapted to receive a banknote released from the temporary storage section;

a first non-taken banknote collection section adapted to receive a banknote remaining in the first return section; and a second non-taken banknote collection section adapted to receive a banknote remaining in the second return section, wherein the temporary storage section is adapted to releasably receive a banknote identified as a genuine banknote by the identification section, and the receipt section includes at least one of the counterfeit banknote collection section, the first non-taken banknote collection section, and the second non-taken banknote collection section.

2. The banknote processing machine according to claim 1, wherein the first return section and the second return section constitute one common return section, the first non-taken banknote collection section and the second non-taken banknote collection section constitute one common non-taken banknote collection section, and the receipt section includes at least the common non-taken banknote collection section.

3. The banknote processing machine according to claim 1, further comprising: a withdrawal section adapted to supply a banknote released from the receive section so as to be removable from the machine; and a third non-taken banknote collection section adapted to receive a banknote remain in the withdrawal section, wherein the receipt section includes at least one of the counterfeit banknote collection section, the first non-taken banknote collection section, the second non-taken banknote collection section and the third non-taken banknote collection section.

4. The banknote processing machine according to claim 3, wherein the first return section, the second return section and the withdrawal section constitute one common delivery section, the first non-taken banknote collection section, the second non-taken banknote collection section and the third non-taken banknote collection section constitute one common non-taken banknote collection section, and the receipt section includes at least the common non-taken banknote collection section.

5. The banknote processing machine according to claim 1, wherein the tape has a discrimination section adapted to discriminate the tape section for partition sheets from another tape section of the tape.

6. A banknote processing machine comprising:

a receipt section adapted to receive a banknote;

a temporary storage section which includes a pair of first and second drums, and a tape wound between the pair of first and second drums, the tape having an end fixed to the first drum, a tape section for banknote sheets and a tape section for partition sheets positioned at a side of the end with respect to the tape section for banknote sheets, the temporary storage section adapted to releasably receive a conveyed banknote by winding the conveyed banknote on the first drum together with the tape section for banknote sheets and to releasably receiving at least one partition sheet by winding the partition sheet on the first drum together with the tape section for partition sheets; and a control section adapted to cause the temporary storage section to release the partition sheet wound on the first drum, and to cause the receipt section to receive the partition sheet from the temporary storage section, in response to the receipt section receiving a banknote, wherein in response to the control section determining that the temporary storage section lacks a partition sheet after performing a normal process mode, the control section is adapted to transition to a partition sheet restock process mode for restocking a partition sheet, and the control section is adapted to allow transition to the normal process mode only when a partition sheet is restocked in the temporary storage section through the partition sheet restock process mode.

7. A banknote processing machine comprising:

a receipt section adapted to receive a banknote;

a temporary storage section which includes a pair of first and second drums, and a tape wound between the pair of first and second drums, the tape having an end fixed to the first drum, a tape section for banknote sheets and a tape section for partition sheets positioned at a side of the end with respect to the tape section for banknote sheets, the temporary storage section adapted to releasably receive a conveyed banknote by winding the conveyed banknote on the first drum together with the tape section for banknote sheets and to releasably receive at least one partition sheet by winding the partition sheet on the first drum together with the tape section for partition sheets; and a control section adapted to cause the temporary storage section to release the partition sheet wound on the first drum, and to cause the receipt section to receive the partition sheet from the temporary storage section, in response to the receipt section receiving a banknote, wherein in response to the control section determining that the temporary storage section lacks a partition sheet, the control section is adapted to output a restock order signal to request restock of a partition sheet.

8. A banknote processing machine comprising: a receipt section adapted to receive a banknote; a temporary storage section which includes a pair of first and second drums, and a tape wound between the pair of first and second drums, the temporary storage section adapted to releasably receive a conveyed banknote by winding the conveyed banknote on the first drum together with the tape, and to releasably receive at least one partition sheet by winding the partition sheet on the second drum together with the tape; and a control section adapted to cause the temporary storage section to release the partition sheet wound on the second drum, and to cause the receipt section to receive the partition sheet from the temporary storage section, in response to the receipt section receiving a banknote.

9. The banknote processing machine according to claim 8, further comprising:

an insertion section adapted to receive a banknote from outside of the machine;

an identification section adapted to identify a banknote received in the insertion section;

a counterfeit banknote collection section adapted to receive a banknote identified as a counterfeit banknote by the identification section;

a first return section adapted to return a banknote unidentified by the identification section so as to be removable from the machine;

a second return section adapted to return a banknote released from the temporary storage section so as to be removable from the machine;

a receive section adapted to return a banknote released from the temporary storage section;

a first non-taken banknote collection section adapted to receive a banknote remaining in the first return section; and a second non-taken banknote collection section adapted to receive a banknote remaining in the second return section, wherein the temporary storage section is adapted to releasably receive a banknote identified as a genuine banknote by the identification section, and the receipt section includes at least one of the counterfeit banknote collection section, the first non-taken banknote collection section, and the second non-taken banknote collection section.

10. The banknote processing machine according to claim 9, wherein the first return section and the second return section constitute one common return section, the first non-taken banknote collection section and the second non-taken banknote collection section constitute one common non-taken banknote collection section, and the receipt section includes at least the common non-taken banknote collection section.

11. The banknote processing machine according to claim 9, further comprising: a withdrawal section adapted to supply a banknote released from the receive section so as to be removable from the machine; and a third non-taken banknote collection section adapted to receive a banknote remain in the withdrawal section, wherein the receipt section includes at least one of the counterfeit banknote collection section, the first non-taken banknote collection section, the second non-taken banknote collection section and the third non-taken banknote collection section.

12. The banknote processing machine according to claim 11, wherein the first return section, the second return section and the withdrawal section constitute one common delivery section, the first non-taken banknote collection section, the second non-taken banknote collection section and the third non-taken banknote collection section constitute one common non-taken banknote collection section, and the receipt section includes at least the common non-taken banknote collection section.

13. The banknote processing machine according to claim 8, wherein the tape has a discrimination section adapted to discriminate the tape section for partition sheets from other tape section of the tape.

14. The banknote processing machine according to claim 8, wherein in response to the control section determining that the temporary storage section lacks a partition sheet after performing a normal process mode, the control section is adapted to transition to a partition sheet restock process mode for restocking a partition sheet, and the control section is adapted to allow transition to the normal process mode only when a partition sheet is restocked in the temporary storage section through the partition sheet restock process mode.

15. The banknote processing machine according to claim 8, wherein in response to the control section determining that the temporary storage section lacks a partition sheet, the control section outputs a restock order signal to request restock of a partition sheet.

* * * * *